US008747174B1

(12) United States Patent
Chun et al.

(10) Patent No.: US 8,747,174 B1
(45) Date of Patent: Jun. 10, 2014

(54) AMPHIBIOUS PROTECTION APPARATUS WITH INFLATABLE WALL MEMBERS AND ENHANCED ACCESS PORTS

(71) Applicant: Hankookin, Inc, Raleigh, NC (US)

(72) Inventors: Andrew Youngho Chun, Raleigh, NC (US); James Jiwen Chun, Raleigh, NC (US); Angela Soyoung Chun, Raleigh, NC (US); Jennifer Miseoung Chun, Raleigh, NC (US)

(73) Assignee: Hankookin, Inc., Raleigh, NC (US)

( * ) Notice: Subject to any disclaimer, the term of this patent is extended or adjusted under 35 U.S.C. 154(b) by 0 days.

(21) Appl. No.: 14/162,770

(22) Filed: Jan. 24, 2014

Related U.S. Application Data

(63) Continuation-in-part of application No. 13/586,150, filed on Aug. 15, 2012, now Pat. No. 8,668,539.

(60) Provisional application No. 61/524,059, filed on Aug. 16, 2011.

(51) Int. Cl.
*B63C 9/06* (2006.01)

(52) U.S. Cl.
USPC ..... 441/87

(58) Field of Classification Search
USPC ..... 441/87; 244/140, 121, 100 R
See application file for complete search history.

(56) References Cited

U.S. PATENT DOCUMENTS

| | | | | | |
|---|---|---|---|---|---|
| 1,281,846 | A | * | 10/1918 | Salari | 244/100 R |
| 3,066,951 | A | * | 12/1962 | Gray | 280/206 |
| 3,883,913 | A | * | 5/1975 | Givens | 441/37 |
| 4,458,895 | A | * | 7/1984 | Turcotte | 482/78 |
| 4,739,953 | A | * | 4/1988 | Soffiantini | 244/121 |
| 4,943,252 | A | * | 7/1990 | Manix | 441/87 |
| 5,283,916 | A | * | 2/1994 | Haro | 5/85.1 |
| 5,768,705 | A | * | 6/1998 | McCloud | 2/69 |
| 6,213,429 | B1 | * | 4/2001 | Chu | 244/140 |

* cited by examiner

*Primary Examiner* — Lars A Olson
*Assistant Examiner* — Jovon Hayes
(74) *Attorney, Agent, or Firm* — Ash Tankha; Lipton, Weinberger & Husick

(57) ABSTRACT

An amphibious protection apparatus includes wall members that define an occupancy space for accommodating one or more users, and an access region for providing access to the occupancy space. Each wall member is foldably and detachably connected to each other. Each wall member includes a thick outer layer defining an outer enclosed space and an inner inflatable member having an inner enclosed space. The outer enclosed space accommodates the inner inflatable member. A fluid injected into the inner enclosed space inflates the inner inflatable member, thereby inflating each detachably connected wall member to form a buoyant enclosure that bounces on land and floats on water. The buoyant enclosure protects the accommodated users from impacts from different directions on land and water. The amphibious protection apparatus also includes an access port having an arrangement of lenses that enables magnification and viewing of objects present in an external environment.

24 Claims, 36 Drawing Sheets

AMPHIBIOUS PROTECTION APPARATUS WITH INFLATABLE WALL MEMBERS AND ENHANCED ACCESS PORTS

CROSS REFERENCE TO RELATED APPLICATIONS

This application is a continuation-in-part application of non-provisional patent application Ser. No. 13/586,150 titled "Amphibious Protection Apparatus", filed in the United States Patent and Trademark Office on Aug. 15, 2012, which claims priority to and the benefit of provisional patent application No. 61/524,059 titled "Personal Protective and Flotation Device", filed in the United States Patent and Trademark Office on Aug. 16, 2011. The specifications of the above referenced patent applications are incorporated herein by reference in their entirety.

BACKGROUND

During dangerous situations, for example, disastrous natural calamities in water and on land such as a tsunami, flash floods, etc., or other calamities such as sailing accidents, falling from high altitudes, etc., which may lead to drowning, impact from sharp objects and heavy objects, being trapped under confined spaces for prolonged periods of time, etc., there is a need for an apparatus that provides safety to a potential victim, for example, by preventing water from reaching the victim, by cushioning the potential victim against harmful impacts, etc.

In such disastrous situations, people do not have time to react since impact is fast and comes from all directions and the event is of a sudden nature. A lifejacket, which is typically used in these situations, does not protect a victim from external impact from different directions. Therefore, there is a need for an apparatus that can be fabricated and is usable in a short period of time and that protects a victim from impact from multiple directions in land and water.

Hence, there is a long felt but unresolved need for a versatile amphibious protection apparatus that is configured for use on land and water, that provides safety to one or more users in dangerous situations, that bounces on land and floats on water, and that protects one or more users accommodated therein from impact from multiple directions.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The amphibious protection apparatus disclosed herein addresses the above mentioned needs for a versatile apparatus configured for use on land and water and that provides safety to one or more users in dangerous situations such a natural calamities, that bounces on land and floats on water, and that protects one or more users accommodated therein from impact from multiple directions. The amphibious protection apparatus disclosed herein protects the users during disastrous natural calamities in water and on land such as a tsunami, flash floods, etc., and other calamities such as sailing accidents, falling from high altitudes, etc., from drowning, impacts from sharp objects and heavy objects, being trapped under confined spaces for prolonged periods of time, etc. The amphibious protection apparatus disclosed herein is configured to inflate and expand at the time of use.

The amphibious protection apparatus disclosed herein comprises a set of wall members that define an occupancy space, and an access region. Each of the wall members is foldably and detachably connected to each other. In an embodiment, the amphibious protection apparatus disclosed herein further comprises a fastener connected at a periphery of each of the wall members. The fastener is configured to attach and detach each of the wall members. The fastener is, for example, a zipper, a hook and loop fastener such as Velcro® of Velcro Industries, etc. Each of the wall members is configured as an inflatable air receptacle with an enclosed space. The enclosed space is configured to be inflated by a fluid, for example, air injected into the enclosed space. Each of the detachably connected wall members can be inflated to form a buoyant enclosure of a predefined configuration configured to bounce on land and float on water. The predefined configuration of the buoyant enclosure formed by the inflation of each of the detachably connected wall members is, for example, a polyhedral configuration such as a tetrahedron, a spherical configuration, a cubic configuration, a cuboidal configuration, etc.

Each of the wall members is made of a flexible and impact resistant material to absorb shock and cushion one or more users accommodated within the occupancy space of the amphibious protection apparatus from impact of external objects such as sharp objects, heavy objects, etc. In an embodiment, the amphibious protection apparatus disclosed herein further comprises an inflation unit operably connected to each of the wall members. The inflation unit is configured to inject a fluid, for example, air into the enclosed space in each of the wall members to instantly inflate each of the wall members. In an embodiment, the amphibious protection apparatus disclosed herein further comprises a valve operably positioned on each of the wall members. The valve is configured to inject a fluid, for example, air into the enclosed space of each of the wall members for inflating each of the wall members or to eject the fluid out of the enclosed space of each of the wall members for deflating each of the wall members.

The occupancy space of the amphibious protection apparatus disclosed herein is defined within the detachably connected wall members. The occupancy space is configured to accommodate one or more users. The buoyant enclosure encloses the accommodated users within the occupancy space to protect the accommodated users from impacts from different directions on land and in water. The access region of the amphibious protection apparatus disclosed herein is defined by opening one of the detachably connected wall members. The access region is configured to provide access to the occupancy space. In an embodiment, the amphibious protection apparatus disclosed herein further comprises a seating member rigidly positioned on a bottom wall member within the occupancy space. The seating member is configured to seat one or more users. In another embodiment, the amphibious protection apparatus disclosed herein further comprises a restraining system operably connected to the seating member. The restraining system is configured to be fastened on each user's body to secure each user within the occupancy space and to protect each user from contacting the wall members.

In an embodiment, the amphibious protection apparatus disclosed herein further comprises one or more buoyancy members attached to an external surface of each of the wall members. The buoyancy members are configured to provide buoyancy to bounce and float the amphibious protection apparatus on land and water respectively, and to provide shock absorbing characteristics to the amphibious protection apparatus. In an embodiment, the amphibious protection apparatus disclosed herein further comprises an access port positioned at a vertex where at least three of the wall members meet. The access port is configured, for example, to introduce a navigation member such as a rudder into the occupancy space for navigating the amphibious protection apparatus on water, to allow entry of air into the occupancy space, to dispose waste matter from the occupancy space, etc. In an embodiment, the amphibious protection apparatus further comprises a plug operably connected to the access port. The plug is configured to internally seal the access port for preventing a fluid external to the occupancy space, for example, water from entering the occupancy space.

In an embodiment, the amphibious protection apparatus disclosed herein further comprises a rescue identifier, for example, a bright color, an array of lights, audio indicators, etc., defined or positioned on the external surface of each of one or more of the wall members. The rescue identifier is configured for identification by rescuers. In another embodiment, the amphibious protection apparatus disclosed herein further comprises one or more storage compartments connected to one or more of the wall members within the occupancy space. The storage compartments are configured to store multiple supplies, for example, food supplies, oxygen tanks, a first aid kit, safety equipment, helmets, etc. In an embodiment, the amphibious protection apparatus disclosed herein further comprises one or more viewing members disposed on one or more of the wall members. The viewing members are configured to aid the accommodated users to view outside the amphibious protection apparatus from within the occupancy space.

The buoyant enclosure of the predefined configuration formed by the inflation of each of the detachably connected wall members allows the amphibious protection apparatus disclosed herein to bounce on land and float on water, thereby protecting the users accommodated within the occupancy space accessed through the access region, from impacts from different directions on land and in water, and providing safety to the accommodated users on land and water.

In an embodiment, each wall member of the amphibious protection apparatus disclosed herein comprises an outer layer of a predetermined thickness and an inner inflatable member. The outer layer of each wall member defines a wall periphery. The wall periphery of the outer layer of each wall member is connected to the wall periphery of the outer layer of another wall member. In an embodiment, the amphibious protection apparatus disclosed herein further comprises a fastener connected at the wall periphery of the outer layer of each wall member. The fastener attaches and detaches each wall member. The fastener is, for example, a zipper, a hook and loop fastener, etc. The outer layer of each wall member is made of a flexible and impact resistant material to absorb shock and cushion the accommodated users from impact of external objects. The outer layer of each wall member defines an outer enclosed space. The outer enclosed space accommodates the inner inflatable member. In an embodiment, the outer layer of each wall member comprises multiple material segments of predefined shapes. As used herein, the phrase "material segments" refers to elemental portions or cut pieces of a fabrication material which are fastened or sutured at their respective edges or peripheries to manufacture the outer layer or the inner inflatable member of each wall member. Each material segment of the outer layer defines a segment periphery. The segment periphery of each material segment of the outer layer is fastened to the segment periphery of another material segment to form the outer enclosed space for the accommodation and inflation of the inner inflatable member.

The inner inflatable member comprises an inner enclosed space. A fluid injected into the inner enclosed space of the inner inflatable member inflates the inner inflatable member. The inflation of the inner inflatable member of each of the detachably connected wall members forms a buoyant enclosure of a predefined configuration, for example, a polyhedral configuration, a cubic configuration, a cuboidal configuration, a spherical configuration, etc., configured to bounce on land and float on water. In an embodiment, the inner inflatable member of each wall member is airtight and conforms to a shape defined by the outer layer of each wall member when inflated. In an embodiment, the inner inflatable member of each wall member comprises multiple material segments of predefined shapes. Each material segment of the inner inflatable member defines a segment periphery. The segment periphery of each material segment is fastened to the segment periphery of another material segment to form the inner enclosed space for receiving the fluid injected into the inner inflatable member.

In an embodiment, the amphibious protection apparatus disclosed herein further comprises an inflation unit operably connected to each wall member. The inflation unit injects the fluid into the inner enclosed space of the inner inflatable member of each wall member to instantly inflate each wall member. In an embodiment, the amphibious protection apparatus disclosed herein further comprises a valve operably positioned on each wall member. The valve injects the fluid into or ejects the fluid out of the inner enclosed space of the inner inflatable member of each wall member for inflation and deflation of each wall member respectively.

The buoyant enclosure formed by the inflation of the inner inflatable member of each of the detachably connected wall members protects the users accommodated within the occupancy space defined by the detachably connected wall members from impacts from different directions on land and water. In an embodiment, the amphibious protection apparatus disclosed herein further comprises a double convex lens positioned at one end of the access port that is proximal to the occupancy space, and a convexo concave lens positioned at a distal end of the access port that is exposed to an external environment. The arrangement of the double convex lens and the convexo concave lens in the access port magnifies external objects present in the external environment. The double convex lens and the convexo concave lens are made of, for example, plastic. In an embodiment, the double convex lens and the convexo concave lens further preclude entry of foreign objects into the occupancy space through the access port.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a structure or a method step referenced by a numeral in a drawing carries over to the description of that structure or method step shown by that same numeral in any subsequent drawing herein.

DETAILED DESCRIPTION OF THE INVENTION

Figure 1A:
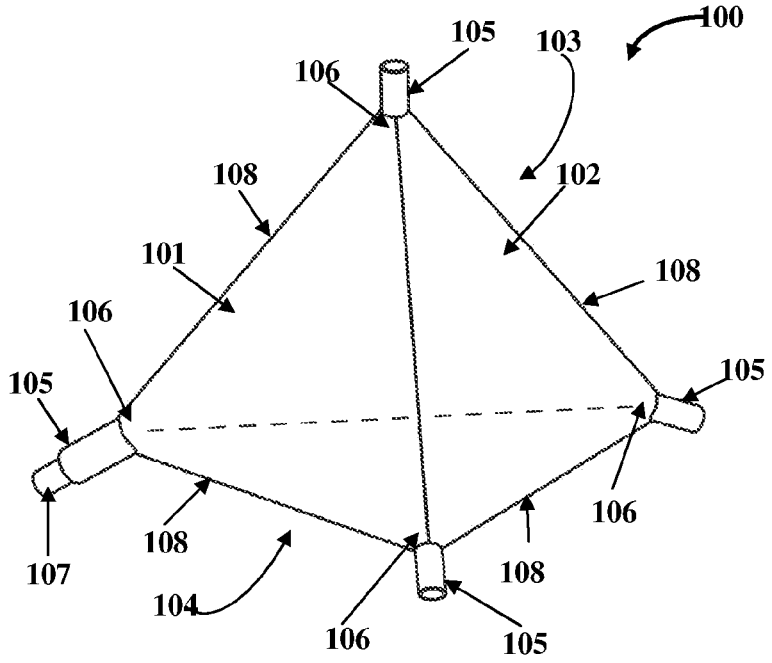
FIG. 1A exemplarily illustrates an isometric view of an amphibious protection apparatus prior to inflation.

FIG. 1A exemplarily illustrates an isometric view of an amphibious protection apparatus 100 prior to inflation. The amphibious protection apparatus 100 disclosed herein comprises a set of wall members 101, 102, 103, and 104. The wall members 101, 102, 103, and 104, for example, a left wall member 101, a right wall member 102, a front wall member 103, and a bottom wall member 104 are foldably and detachably connected to each other. Each of the wall members 101, 102, 103, and 104 is configured as an inflatable air receptacle with an enclosed space 118 as exemplarily illustrated in FIGS. 5-6. The enclosed space 118 is configured to be inflated by a fluid, for example, air injected into the enclosed space 118 via a valve 117 positioned on each of the wall members 101, 102, 103, and 104 as exemplarily illustrated in FIGS. 5-6. In an embodiment, the amphibious protection apparatus 100 disclosed herein further comprises a fastener 108 connected at a periphery, for example, 101*b*, 102*b*, etc., of each of the wall members 101, 102, etc., as disclosed in the detailed description of FIG. 10.

Figure 2A:
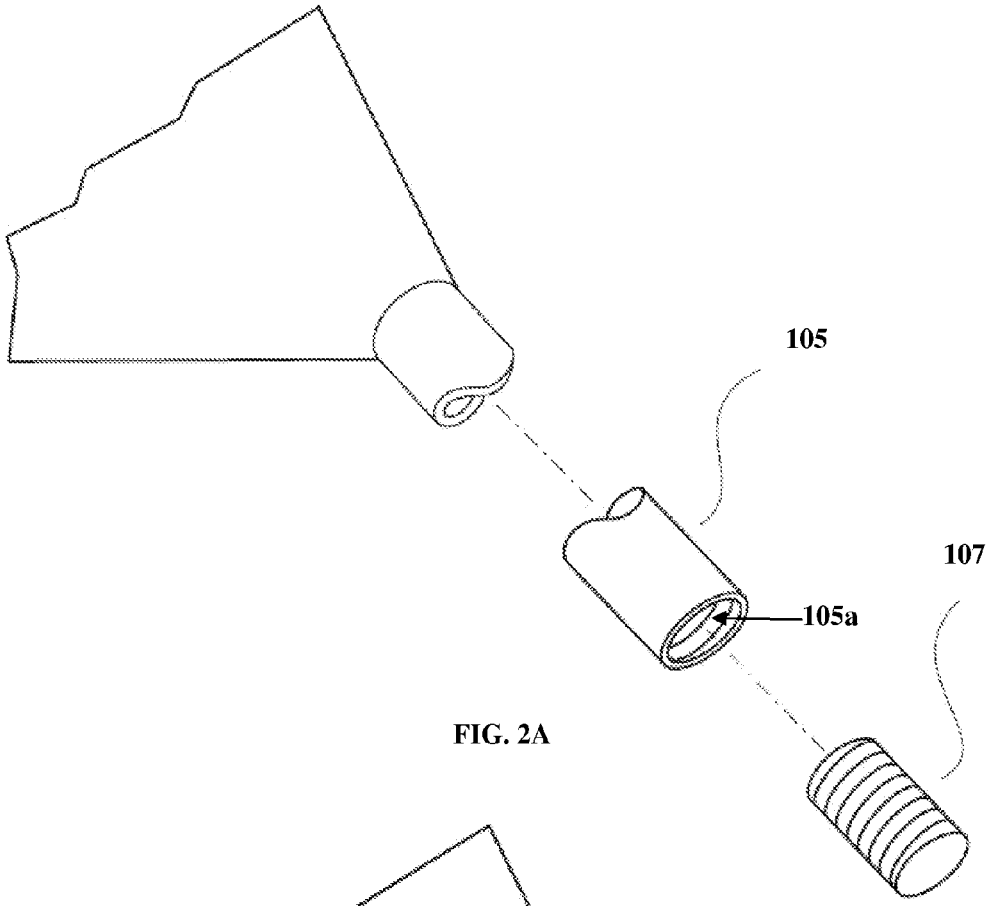
FIG. 2A exemplarily illustrates a partial exploded view showing an access port and a plug.
Figure 2B:
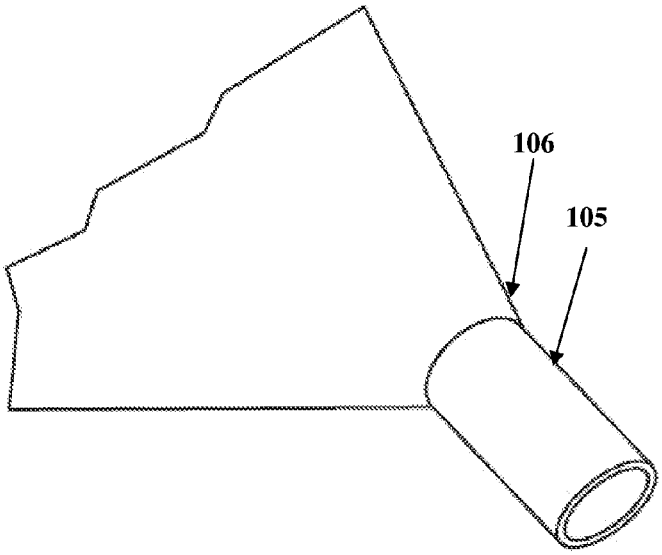
FIG. 2B exemplarily illustrates a partial view showing an access port extending from a vertex.
Figure 10:
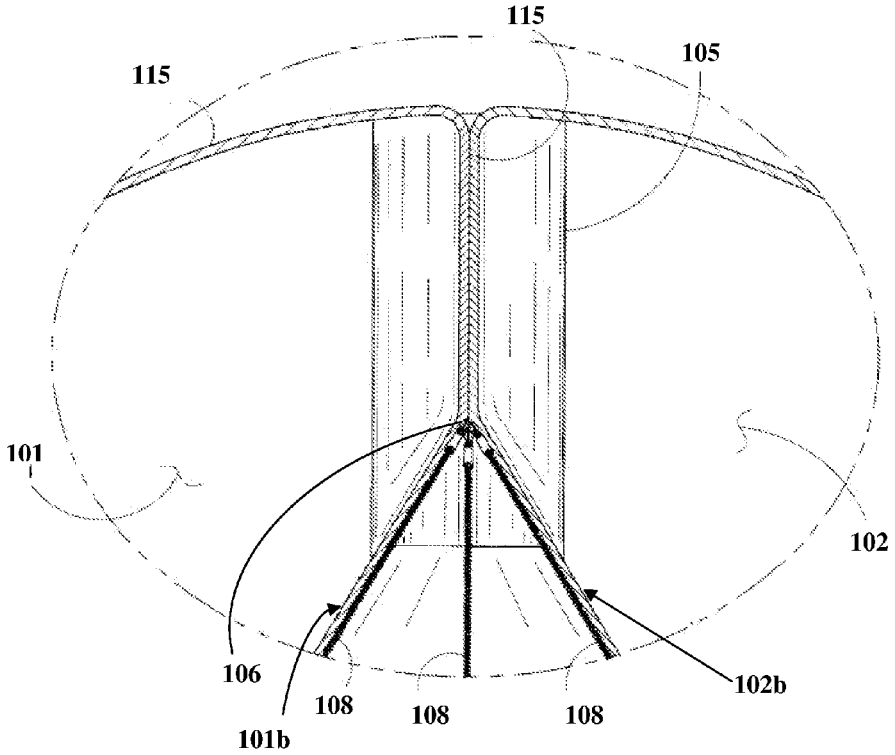
FIG. 10 exemplarily illustrates an enlarged view of an access port of the amphibious protection apparatus after inflation of the wall members.

In an embodiment, the amphibious protection apparatus 100 disclosed herein further comprises an access port 105 positioned at a vertex 106 where at least three of the wall members 101, 102, 103, and 104 meet as disclosed in the detailed description of FIGS. 2A-2B and FIG. 10. The access port 105 is configured, for example, to introduce a navigation member 1401 such as a rudder into an occupancy space 110 defined by the detachably connected wall members 101, 102, 103, and 104, as exemplarily illustrated in FIG. 14B, for navigating the amphibious protection apparatus 100, to allow entry of air into the occupancy space 110, to dispose waste matter from the occupancy space 110, etc. In an embodiment, the amphibious protection apparatus 100 further comprises a plug 107 operably connected to the access port 105 as disclosed in the detailed description of FIG. 2A.

Figure 1B:
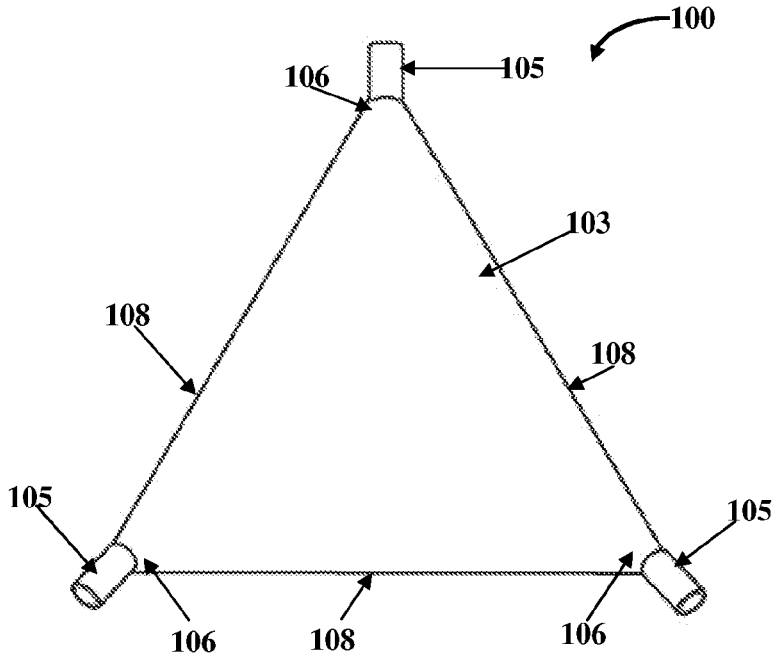
FIG. 1B exemplarily illustrates a front elevation view of the amphibious protection apparatus prior to inflation.
Figure 1C:
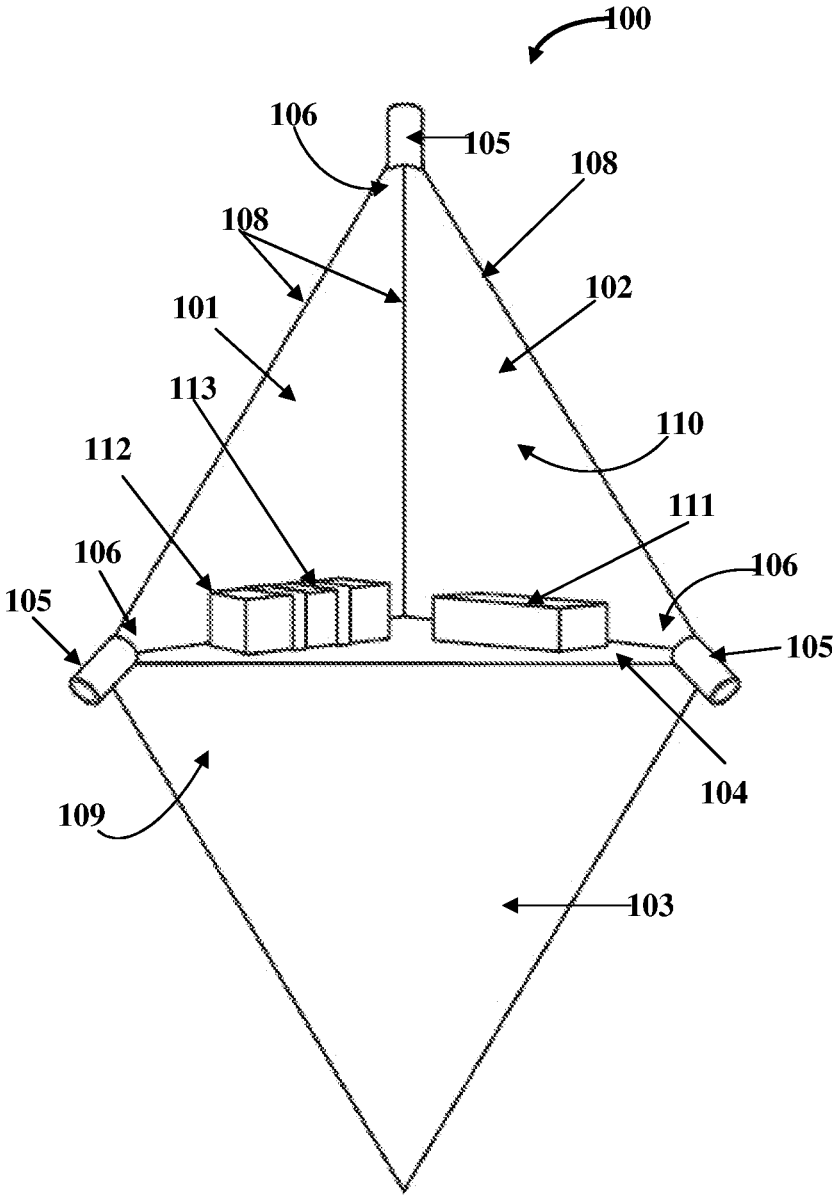
FIG. 1C exemplarily illustrates a front elevation view of the amphibious protection apparatus prior to inflation, showing an open access region.

FIG. 1B exemplarily illustrates a front elevation view of the amphibious protection apparatus 100 prior to inflation. Each of the wall members 101, 102, 103, and 104 of the amphibious protection apparatus 100 exemplarily illustrated in FIGS. 1A-1C, is made of a flexible and impact resistant material, for example, a strong resilient rubber, a nylon coated material, a silicone coated material, etc., that is air tight and can absorb shock and cushion a user 701 accommodated within the occupancy space 110 as exemplarily illustrated in FIGS. 7-8 and FIG. 15A, from impact of external objects. The materials used for construction of the wall members 101, 102, 103, and 104 may be commercially available strong, flexible, water-resistant or air tight materials used, for example, in water rafting tubing, parachutes, lifesavers, etc. The materials used for constructing the wall members 101, 102, 103, and 104 comprise, for example, polyvinyl chloride (PVC) tarpaulin, thermoplastic elastomers, polyester fabrics, synthetic fibers, etc. In order to increase the strength of each of the wall members 101, 102, 103, and 104, a rubber and a silicone can be fused into strong nylon fabrics for constructing the wall members 101, 102, 103, and 104. Each of the wall members 101, 102, 103, and 104 is pre-shaped in its collapsed state, and folded like an automobile airbag. When inflated with a fluid, for example, air, the wall members 101, 102, 103, and 104 take their expanded shape as exemplarily illustrated in FIGS. 3A-3B and FIG. 4B.

FIG. 1C exemplarily illustrates a front elevation view of the amphibious protection apparatus 100 prior to inflation, showing an open access region 109. The amphibious protection apparatus 100 disclosed herein comprises wall members 101, 102, 103, and 104 that define an occupancy space 110 for accommodating one or more users 701 as exemplarily illustrated in FIGS. 7-8 and FIG. 15A, and an access region 109 to allow the users 701 to enter the occupancy space 110. Each of the wall members 101, 102, 103, and 104 are detachably connected to define the occupancy space 110 that is configured to accommodate one or more users 701. As exemplarily illustrated in FIG. 1C, the amphibious protection apparatus 100 disclosed herein is constructed and arranged such that a user 701 is able to enter the occupancy space 110 through the access region 109 and be seated in the occupancy space 110. The access region 109 of the amphibious protection apparatus 100 disclosed herein is defined by opening one of the detachably connected wall members 101, 102, 103, and 104, for example, the front wall member 103 as exemplarily illustrated in FIG. 1C, FIGS. 7-8, and FIG. 15A. The access region 109 is configured to provide access to the occupancy space 110.

In an embodiment, the amphibious protection apparatus 100 disclosed herein further comprises a seating member 111 rigidly positioned on the bottom wall member 104 within the occupancy space 110. The seating member 111 is configured to seat one or more users 701 as exemplarily illustrated in FIGS. 7-8 and FIG. 15A. In another embodiment, the amphibious protection apparatus 100 disclosed herein further comprises one or more storage compartments 112 connected to one or more of the wall members 101, 102, 103, and 104 within the occupancy space 110. The storage compartments 112 are configured to store multiple supplies, for example, food supplies, oxygen tanks, a first aid kit, safety equipment, helmets, manually inflatable air cushions, etc. As exemplarily illustrated in FIG. 1C, FIGS. 7-8, FIGS. 14A-14B, and FIG. 15A, a single storage compartment 112 is connected to the bottom wall member 104. The storage compartment 112 has storage tie down straps 113 for securely and firmly storing the supplies.

FIG. 2A exemplarily illustrates a partial exploded view showing an access port 105 and a plug 107. The access port 105 extends from a vertex 106 as exemplarily illustrated in FIG. 2B. The plug 107 operably connected to the access port 105 is configured to internally seal the access port 105 for preventing a fluid external to the occupancy space 110, for example, water from entering the occupancy space 110. The plug 107 is configured, for example, as a screw head as exemplarily illustrated in FIG. 2A. The inner surface 105*a* of the access port 105 comprises a screw lining that is configured to engage with the plug 107. A user 701 accommodated within the occupancy space 110 as exemplarily illustrated in FIGS. 7-8 and FIG. 15A, can engage the plug 107 into the access port 105, from within the occupancy space 110, to form a seal and can disengage the plug 107 from the access port 105 to open the access port 105. The user 701 accommodated within the occupancy space 110 may insert the plug 107 into the access port 105 to seal the access port 105.

Figure 3A:
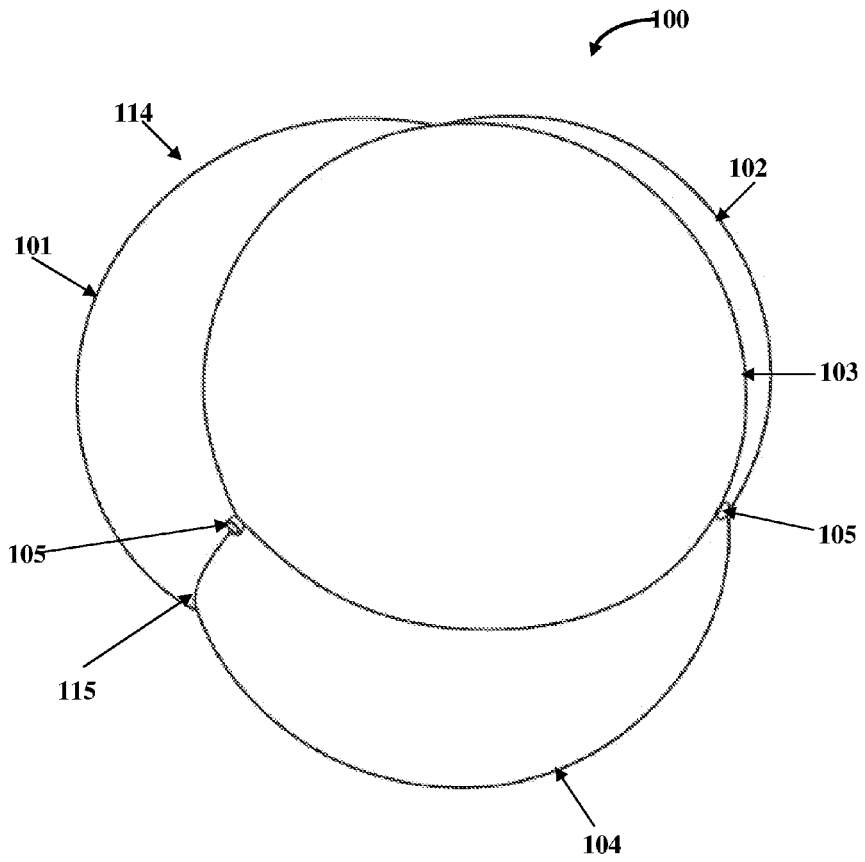
FIGS. 3A-3B exemplarily illustrate isometric views of the amphibious protection apparatus after inflation.
Figure 3B:
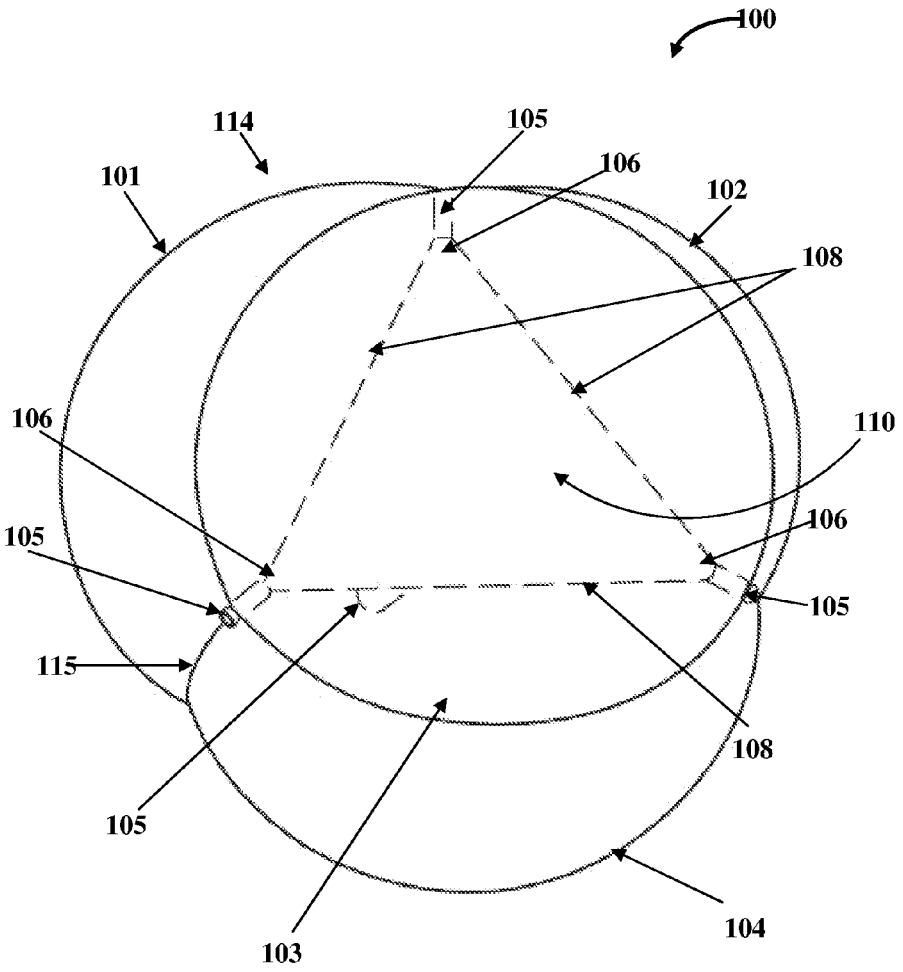

FIGS. 3A-3B exemplarily illustrate isometric views of the amphibious protection apparatus 100 after inflation. Each of the detachably connected wall members 101, 102, 103, and 104 exemplarily illustrated in FIGS. 1A-1C, is inflated to form a buoyant enclosure 114 exemplarily illustrated in FIGS. 3A-3B and FIG. 4B, of a predefined configuration configured to bounce on land and float on water. The predefined configuration of the buoyant enclosure 114 formed by the inflation of each of the detachably connected wall members 101, 102, 103, and 104 is a polyhedral configuration, for example, a tetrahedron as exemplarily illustrated in FIGS. 3A-3B, FIG. 4B, FIGS. 7-9, FIGS. 11-12, and FIG. 17. The scope of the amphibious protection apparatus 100 disclosed herein is not limited to the buoyant enclosure 114 being formed in a polyhedral configuration but may be extended to include a buoyant enclosure 114 formed in a spherical configuration as exemplarily illustrated in FIGS. 15A-15D, a cubic configuration, a cuboidal configuration, and other functionally equivalent configurations.

Figure 4A:
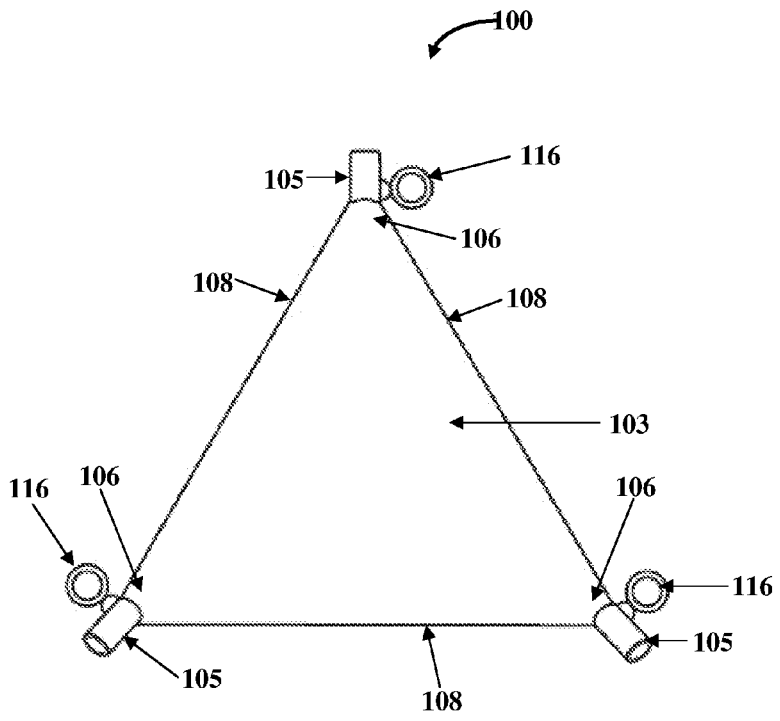
FIG. 4A exemplarily illustrates a front elevation view of the amphibious protection apparatus prior to inflation, showing ring members.
Figure 4B:
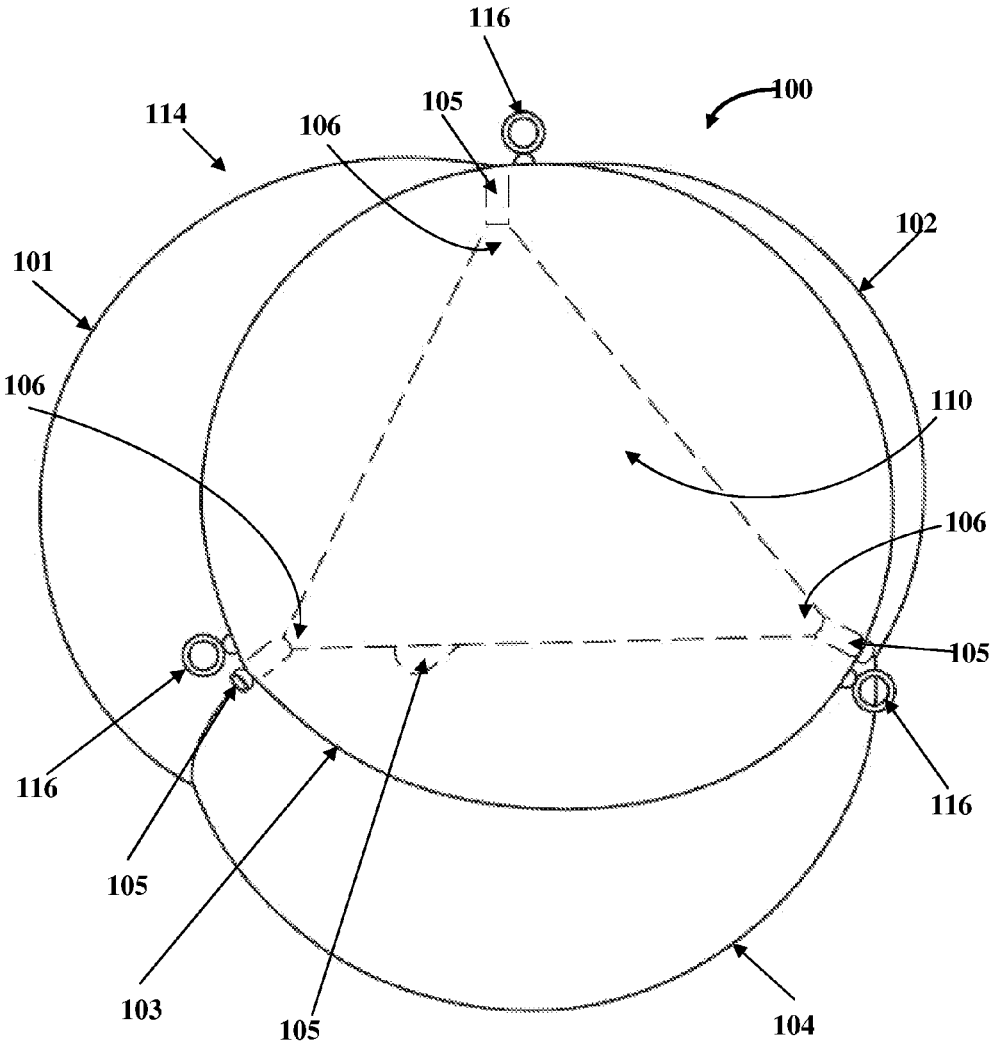
FIG. 4B exemplarily illustrates an isometric view of the amphibious protection apparatus after inflation, showing the ring members.

FIG. 4A and FIG. 4B exemplarily illustrate a front elevation view and an isometric view of the amphibious protection apparatus 100 prior to and after inflation respectively, showing ring members 116. In an embodiment, the amphibious protection apparatus 100 disclosed herein further comprises ring members 116 rigidly attached to and extending outwardly from the wall members 101, 102, 103, and 104. The ring members 116 are configured to anchor the amphibious protection apparatus 100 to a stabilizing object (not shown), for example, through a hook and cable arrangement to preclude or limit the movement of the amphibious protection apparatus 100 and to prevent the amphibious protection apparatus 100 from drifting away on water.

Figure 5:
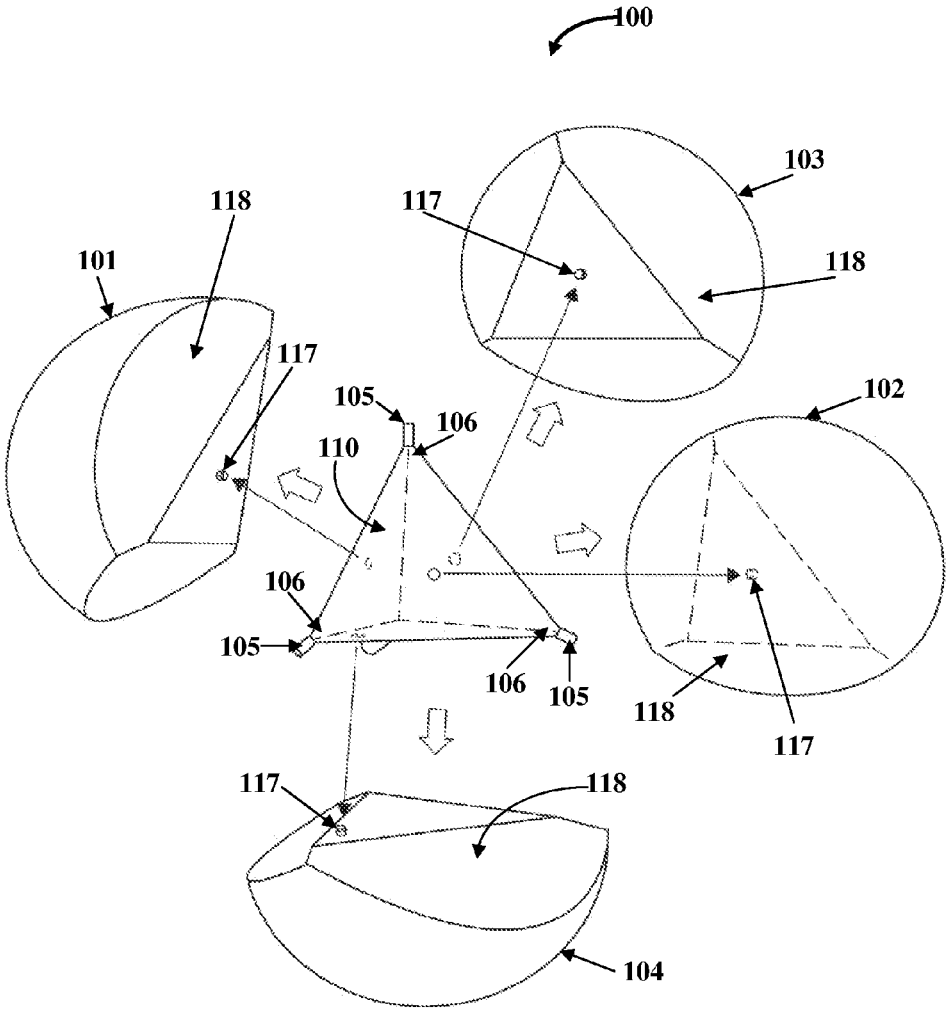
FIG. 5 exemplarily illustrates an exploded view of the amphibious protection apparatus after inflation.

FIG. 5 exemplarily illustrates an exploded view of the amphibious protection apparatus 100 after inflation. As exemplarily illustrated in FIG. 5, each of the wall members 101, 102, 103, and 104 of the tetrahedral amphibious protection apparatus 100 is configured in the shape of, for example, an equilateral triangle that can be inflated into a partial sphere. The length of a side of each of the wall members 101, 102, 103, and 104 is, for example, from about one meter for a small sized amphibious protection apparatus 100 to about two meters for a large sized amphibious protection apparatus 100. As exemplarily illustrated in FIG. 5, each of the wall members 101, 102, 103, and 104 inflates to form partial spheres. The thickness of each partial sphere is, for example, from about 0.5 meters to about 1 meter to provide a sufficient buffer for strong impacts. In an embodiment, the amphibious protection apparatus 100 disclosed herein further comprises a valve 117 operably positioned on each of the wall members 101, 102, 103, and 104. The valve 117 is configured to inject a fluid, for example, air into the enclosed space 118 of each of the wall members 101, 102, 103, and 104 for inflating each of the wall members 101, 102, 103, and 104. The valve 117 is also configured to eject a fluid, for example, air out of the enclosed space 118 of each of the wall members 101, 102, 103, and 104 for deflating each of the wall members 101, 102, 103, and 104. The inflation of the wall members 101, 102, 103, and 104 is disclosed in the detailed description of FIG. 6.

Figure 6:
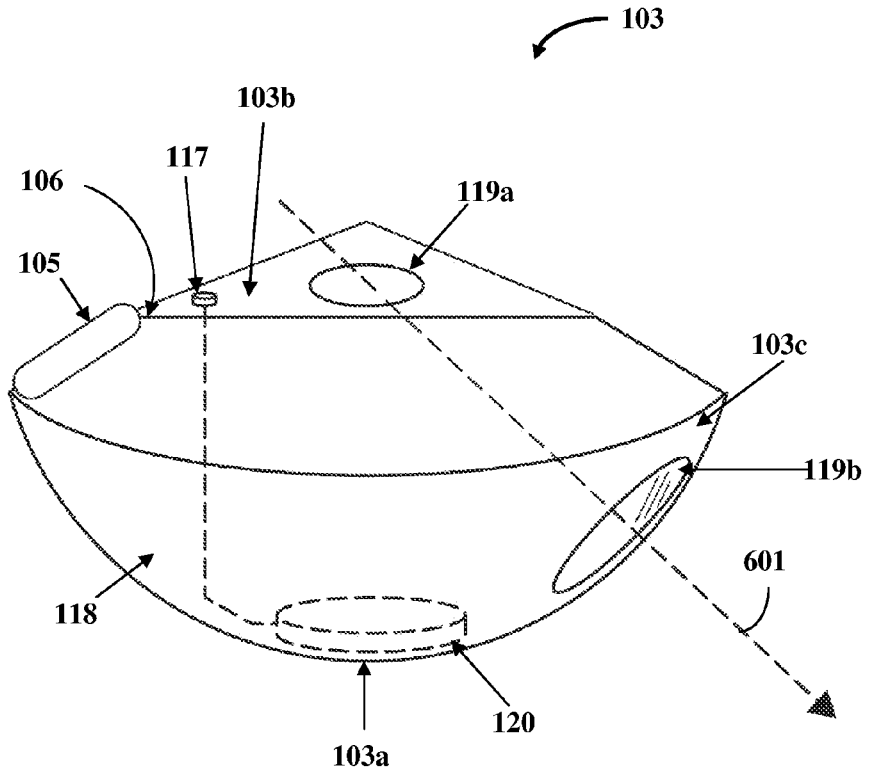
FIG. 6 exemplarily illustrates a perspective view of one of the inflated wall members of the amphibious protection apparatus, showing an inflation unit and viewing members.

FIG. 6 exemplarily illustrates a perspective view of one of the inflated wall members, for example, the front wall member 103 of the amphibious protection apparatus 100, showing an inflation unit 120 and viewing members 119*a* and 119*b*. In an embodiment, the amphibious protection apparatus 100 disclosed herein further comprises an inflation unit 120 operably connected to each of the wall members 101, 102, 103, and 104 exemplarily illustrated in FIG. 5, at a location a safe distance away from the user 701 accommodated within the occupancy space 110 exemplarily illustrated in FIGS. 7-8 and FIG. 15A. For example, the inflation unit 120 is positioned within the enclosed space 118 of the front wall member 103 at an apex 103*a* of the wall member 103 as exemplarily illustrated in FIG. 6. Similarly, the inflation unit 120 is positioned within the enclosed space 118 at the apex of each of the other wall members 101, 102, and 104. In an embodiment, the inflation unit 120 is, for example, a generally cylindrical canister operably connected to the valve 117 positioned on an inner surface 103*b* of the wall member 103, which is opposite to the apex 103*a* of the wall member 103 as exemplarily illustrated in FIG. 6. The valve 117 on each of the wall members 101, 102, 103, and 104 exemplarily illustrated in FIG. 5, activates the corresponding inflation units 120, for example, by triggering an electric pulse.

On activation by the valve 117, the inflation unit 120 injects a fluid, for example, air into the enclosed space 118 in each of the wall members 101, 102, 103, and 104 to instantly inflate each of the wall members 101, 102, 103, and 104. In an embodiment, the user 701 exemplarily illustrated in FIGS. 7-8 and FIG. 15A, may manually pump a fluid, for example, air into the enclosed space 118 of each of the wall members 101, 102, 103, and 104 through the valve 117 using an air pump (not shown). The air pump is, for example, a mechanical pump or an electrical pump that injects a small amount of air into the enclosed space 118 in each of the wall members 101, 102, 103, and 104 via the valve 117. In an embodiment, compressed gas expands or inflates the left wall member 101, the right wall member 102, the front wall member 103, and the bottom wall member 103. The air may be pumped into the enclosed space 118 within each of the wall members 101, 102, 103, and 104, for example, using an internal air inflation system similar to a system that inflates an automobile airbag, and an external air pump. The internal air inflation system uses a mixture of air generating compounds, for example, sodium azide, potassium nitrate, and silicon oxide, and an electric impulse that generates a temperature of about 300° C. to inflate each of the wall members 101, 102, 103, and 104.

In an embodiment where instantaneous inflation is not required, air can be pumped electrically from tubes (not shown) positioned inside the occupancy space 110 proximal to the seating member 111 exemplarily illustrated in FIG. 1C, FIGS. 7-8, FIGS. 14A-14B, and FIG. 15A. The tubes are connected to each of the wall members 101, 102, 103, and 104 via the valve 117.

In another embodiment, the amphibious protection apparatus 100 disclosed herein further comprises one or more viewing members 119*a* and 119*b* disposed on each of the wall members 101, 102, 103, and 104. As exemplarily illustrated in FIG. 6, an inner viewing member 119*a* on the inner surface 103*b* of the wall member 103 corresponds to an outer viewing member 119*b* on the outer surface 103*c* of the wall member 103. The viewing members 119*a* and 119*b* allow a user 701 accommodated within the occupancy space 110 to view from inside the occupancy space 110 to the outside of the amphibious protection apparatus 100. The line of vision that allows the user 701 to view outside of the amphibious protection apparatus 100 is represented by an arrow 601 in FIG. 6. The viewing members 119*a* and 119*b* are configured to aid the accommodated user 701 to view outside the amphibious protection apparatus 100 from within the occupancy space 110. The viewing members 119*a* and 119*b* are, for example, oval shaped and made from a clear resilient plastic material for visualization during navigation.

Figure 7:
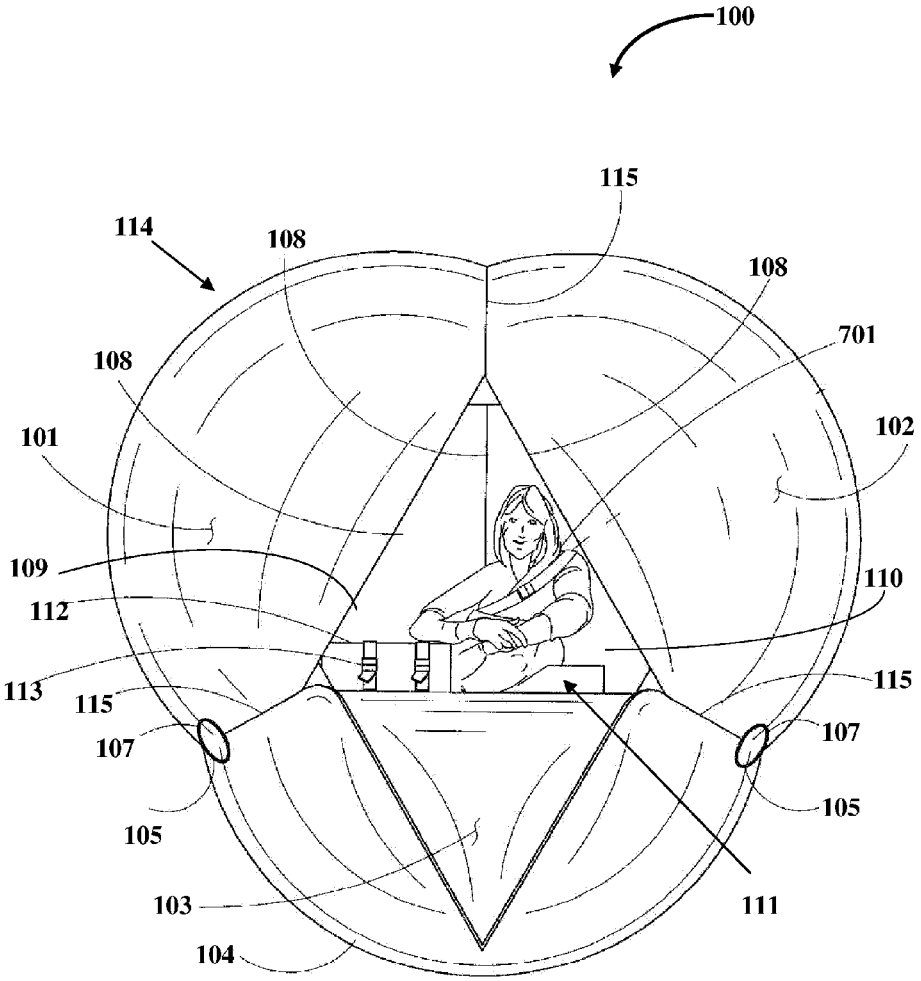
FIG. 7 exemplarily illustrates a front elevation view of the amphibious protection apparatus, showing an open access region.

FIG. 7 exemplarily illustrates a front elevation view of the amphibious protection apparatus 100, showing an open access region 109. A user 701 may enter the occupancy space 110 defined by the detachably connected wall members 101, 102, 103, and 104 through the access region 109. The user 701 unfastens the fastener 108 that connects the front wall member 103 to the left wall member 101 and the right wall member 102 to open the access region 109 and enter into the occupancy space 110 or exit out of the occupancy space 110. Although FIGS. 7-8 and FIG. 15A exemplarily illustrate accommodation of a single user 701 within the occupancy space 110, the amphibious protection apparatus 100 can be constructed in multiple different sizes to accommodate more than one user 701. The buoyant enclosure 114 formed by inflation of the detachably connected wall members 101, 102, 103, and 104 encloses the accommodated user 701 on all sides within the occupancy space 110. The user 701 accommodated within the occupancy space 110 can enclose himself/herself within the occupancy space 110 by fastening or closing the fastener 108 that connects the front wall member 103 to the left wall member 101 and the right wall member 102.

The buoyant enclosure 114 of the predefined configuration formed by the inflation of each of the detachably connected wall members 101, 102, 103, and 104 allows the amphibious protection apparatus 100 to bounce on land and float on water, thereby protecting the user 701 accommodated within the occupancy space 110 accessed through the access region 109, from impacts from different directions on land and water, and providing safety to the accommodated user 701 on land and water. The amphibious protection apparatus 100 therefore cushions the user 701 from impact from multiple directions, provides a floating support to float on water, and acts as a buffer against sudden and hard impact.

Figure 8:
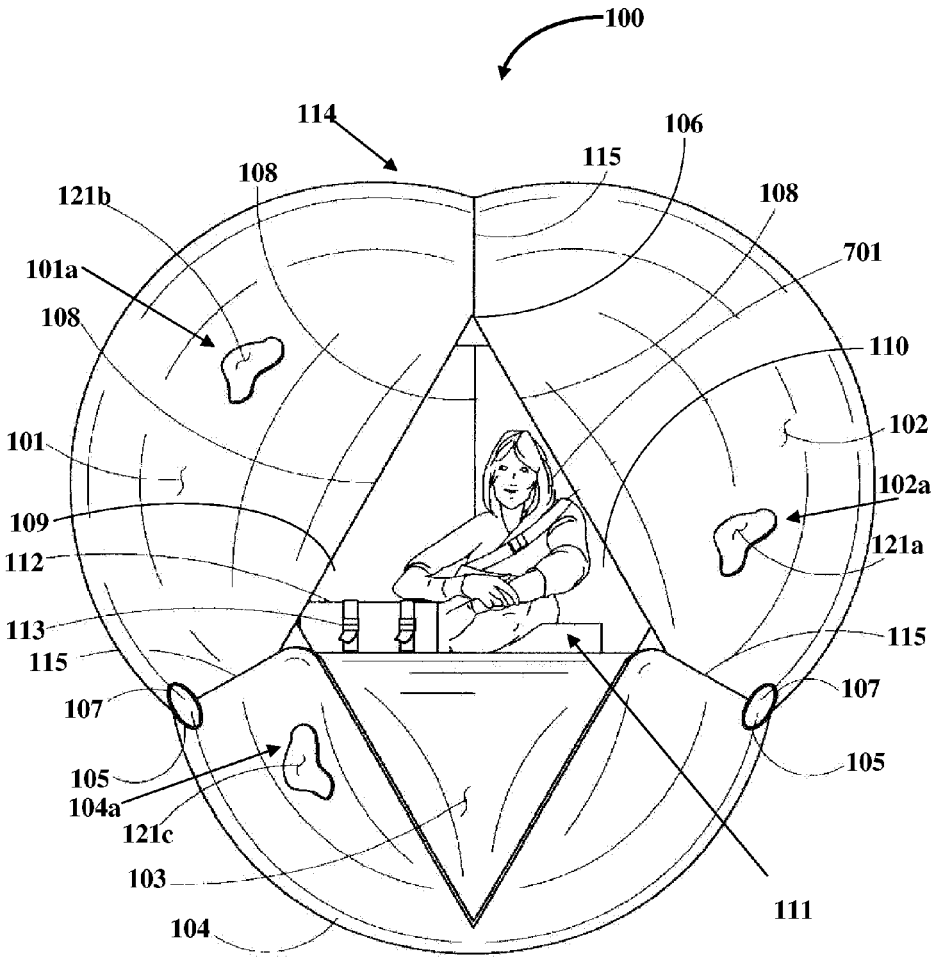
FIG. 8 exemplarily illustrates a front elevation view of an embodiment of the amphibious protection apparatus, showing buoyancy members.

FIG. 8 exemplarily illustrates a front elevation view of an embodiment of the amphibious protection apparatus 100, showing buoyancy members 121*a*, 121*b*, and 121*c*. The amphibious protection apparatus 100 disclosed herein comprises the wall members 101, 102, 103, and 104, the occupancy space 110, and the access region 109 as disclosed in the detailed description of FIGS. 1A-1C. In an embodiment, the amphibious protection apparatus 100 disclosed herein further comprises one or more buoyancy members 121*a*, 121*b*, and 121*c*, for example, a right side buoyancy member 121*a*, a left side buoyancy member 121*b*, and a bottom buoyancy member 121*c* attached, for example, to the external surfaces 101*a*, 102*a*, and 104*a* of the wall members 101, 102, and 104 respectively. The buoyancy members 121*a*, 121*b*, and 121*c* are configured to provide buoyancy to bounce and float the amphibious protection apparatus 100 on land and water respectively, and to provide and facilitate shock absorbing characteristics to the amphibious protection apparatus 100 on land and in water. Each of the buoyancy members 121*a*, 121*b*, and 121*c* are configured as pockets that contain an article or a material, for example, a foam based air seal cushion that provides sufficient buoyancy and a cushioning effect for the amphibious protection apparatus 100, when the amphibious protection apparatus 100 comes in contact with external objects. The buoyancy members 121*a*, 121*b*, and 121*c* are glued and adhere, for example, to the external surfaces 101*a*, 102*a*, and 104*a* of the wall members 101, 102, and 104 respectively, for providing additional protection against impact.

The amphibious protection apparatus 100 disclosed herein is configured to protect the user 701 accommodated within the occupancy space 110 when the amphibious protection apparatus 100 is dropped from an altitude, for example, an elevated location such as a cliff, elevated floors of a building, a mountain, etc., to a surface below, for example, a ground surface. The amphibious protection apparatus 100 protects and cushions the user 701 in all 360° angles from a sudden impact. The amphibious protection apparatus 100 also provides protection during a sports activity, for example, rolling down a high mountain during mountain climbing, white water rafting, etc. The amphibious protection apparatus 100 also provides a cushioning effect to escape from a disaster, for example, during a fall from an altitude from a vertical height such as a high rise building, while jumping out of an aircraft, etc.

Figure 9:
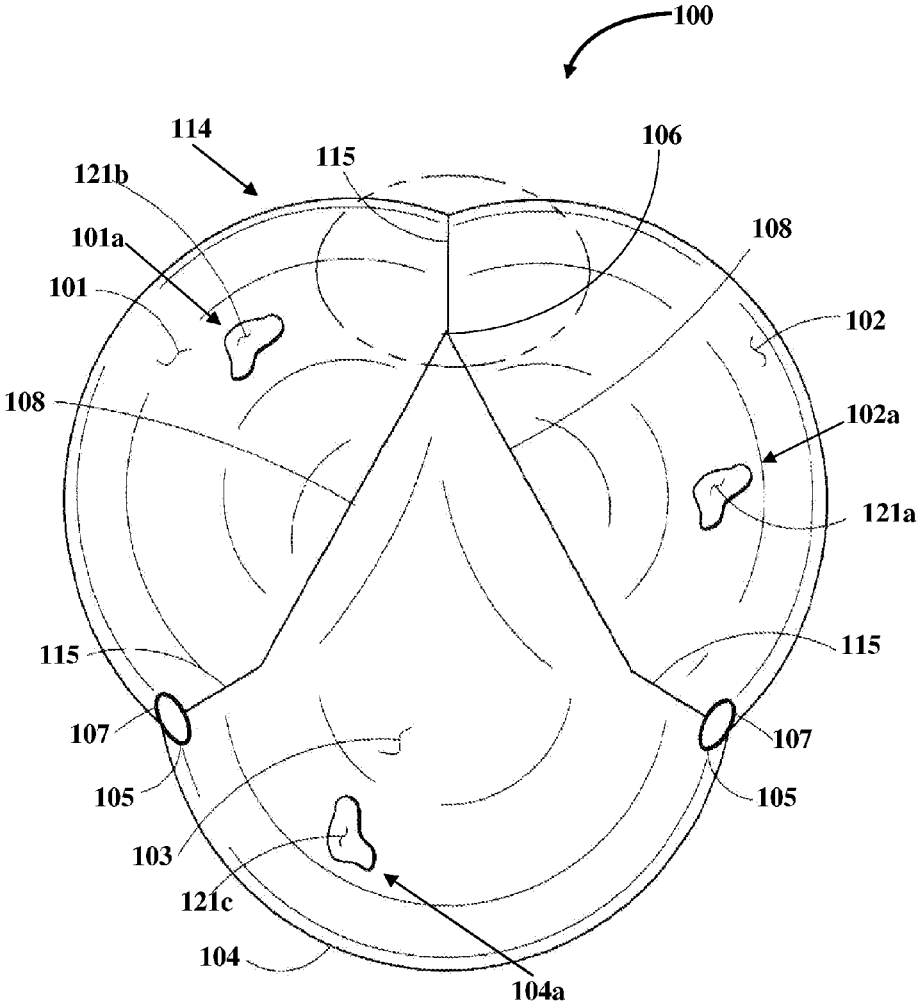
FIG. 9 exemplarily illustrates a front elevation view of the embodiment of the amphibious protection apparatus, showing a closed access region.

FIG. 9 exemplarily illustrates a front elevation view of the embodiment of the amphibious protection apparatus 100, showing a closed access region 109. The access region 109 exemplarily illustrated in FIG. 8, is defined by opening, for example, the front wall member 103. The front wall member 103 is constructed and arranged to be a door like structure, whereby the front wall member 103 opens and closes to permit a user 701 access to the occupancy space 110 of the amphibious protection apparatus 100. After entering into the occupancy space 110 defined by the detachably connected wall members 101, 102, 103, and 104, the user 701 may close the access region 109 created by the front wall member 103 using the fasteners 108 that connect the front wall member 103 to the left wall member 101 and the right wall member 102.

FIG. 10 exemplarily illustrates an enlarged view of an access port 105 of the amphibious protection apparatus 100 after inflation of the wall members 101, 102, 103, and 104. An access port 105 is positioned at a vertex 106 where at least three of the wall members 101, 102, 103, and 104 meet. The access port 105 is configured, for example, to introduce a navigation member 1401 such as a rudder into the occupancy space 110, as exemplarily illustrated in FIG. 14B, for navigating the amphibious protection apparatus 100, to allow entry of air into the occupancy space 110, to dispose waste matter from the occupancy space 110, etc. The fasteners 108 are connected at the peripheries, for example, 101*b*, 102*b*, etc., of the wall members 101, 102, etc. The fastener 108 is configured to attach and detach each of the wall members 101, 102, 103, and 104. The fastener 108 is, for example, a water proof zipper or a hook and loop fastener such as Velcro® of Velcro Industries.

As exemplarily illustrated in FIG. 10, the left wall member 101 is partially and rigidly connected to the right wall member 102 using a permanent seal 115. The remaining portion of the periphery 101*b* of the left wall member 101 is detachably connected to the remaining portion of the periphery 102*b* of the right wall member 102 using the fasteners 108. The fasteners 108 are stitched to the peripheries, for example, 101*b*, 102*b*, etc., of the wall members 101, 102, etc., and coated, for example, with rubber or silicone for creating an airtight or a water tight seal. The fasteners 108 similarly fasten the peripheries of the front wall member 103 to the peripheries 101*b* and 102*b* of the left wall member 101 and the right wall member 102 respectively. Each access port 105 further incorporates a plug 107 exemplarily illustrated in FIG. 2A, configured to internally seal the access port 105 for preventing a fluid external to the occupancy space 110, for example, water from entering the occupancy space 110 of the amphibious protection apparatus 100.

Figure 11:
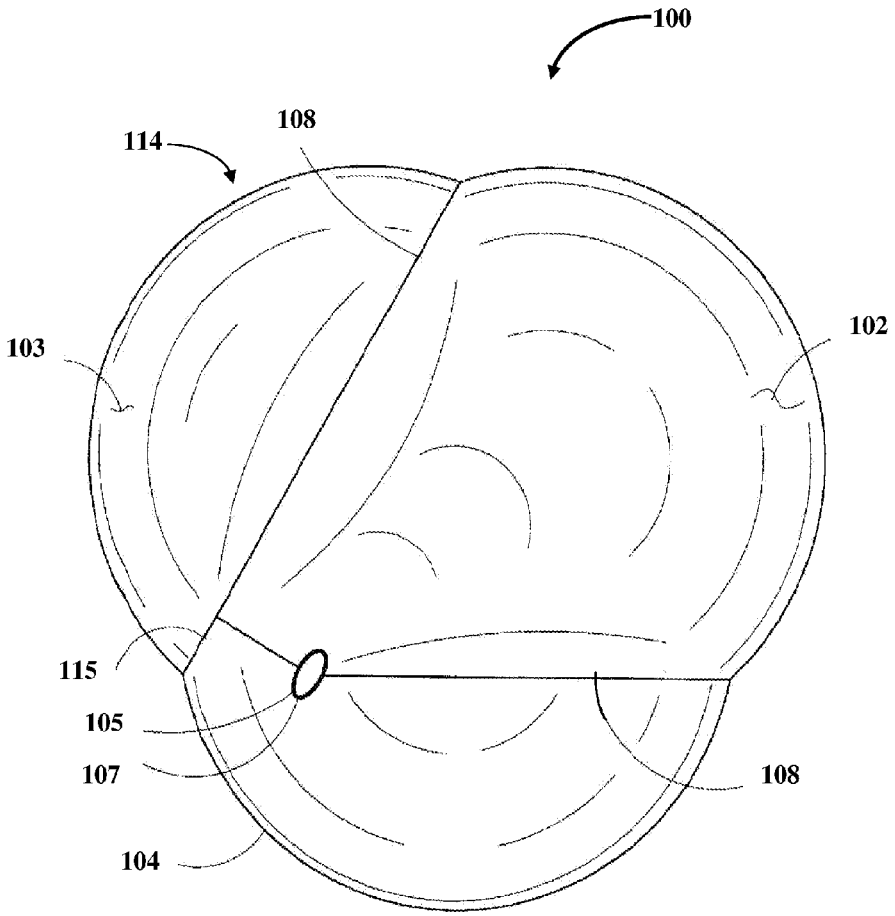
FIG. 11 exemplarily illustrates a right side elevation view of the amphibious protection apparatus with inflated wall members.

FIG. 11 exemplarily illustrates a right side elevation view of the amphibious protection apparatus 100 with inflated wall members 102, 103, and 104. The wall members 102, 103, and 104, the fasteners 108, the access port 105, the plug 107, and the permanent seal 115 between the wall members 102, 103, and 104 exemplarily illustrated in FIG. 11, are disclosed in the detailed descriptions of FIGS. 1A-10.

Figure 12:
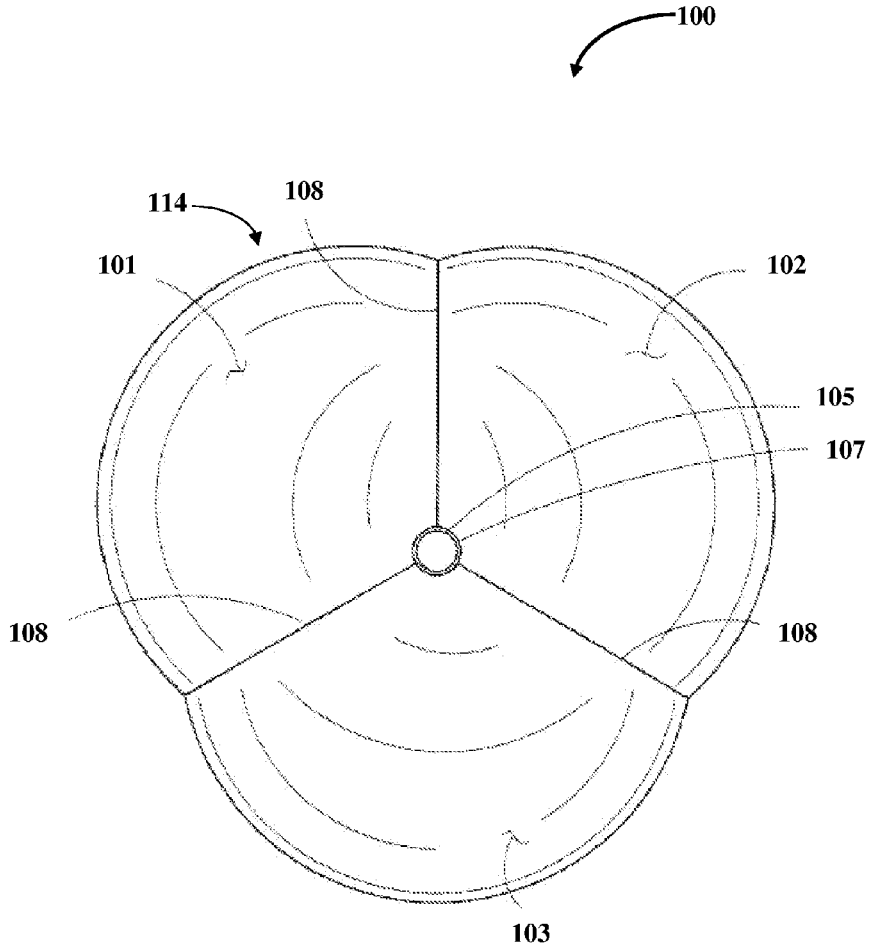
FIG. 12 exemplarily illustrates a plan view of the amphibious protection apparatus with inflated wall members.

FIG. 12 exemplarily illustrates a plan view of the amphibious protection apparatus 100 with inflated wall members 101, 102, and 103. The wall members 101, 102, and 103, the fasteners 108, the access port 105, and the plug 107 exemplarily illustrated in FIG. 12, are disclosed in the detailed descriptions of FIGS. 1A-10.

Figure 13A:
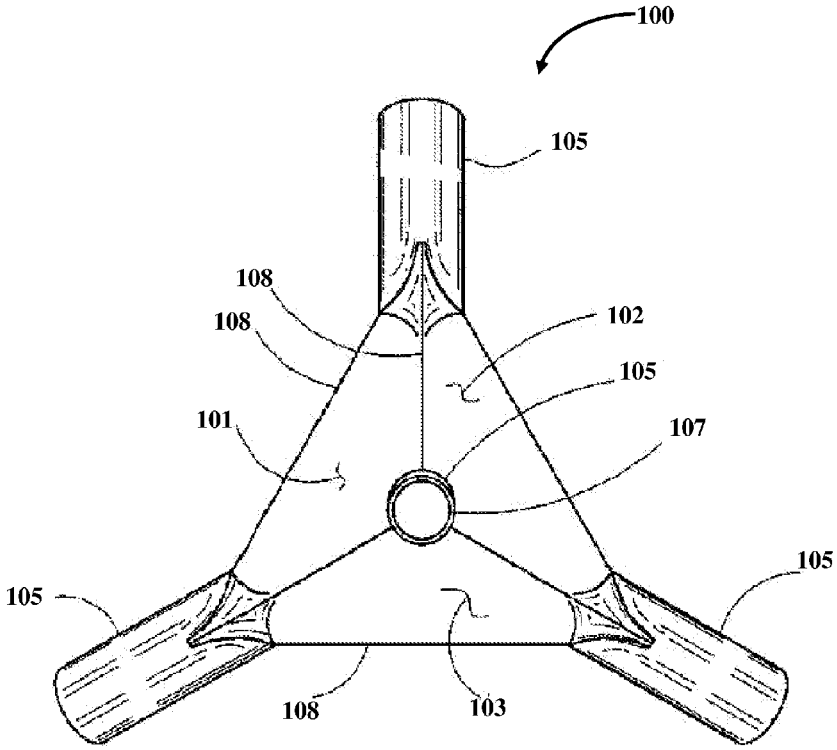
FIG. 13A exemplarily illustrates a plan view of the amphibious protection apparatus prior to inflation of the wall members.
Figure 13B:
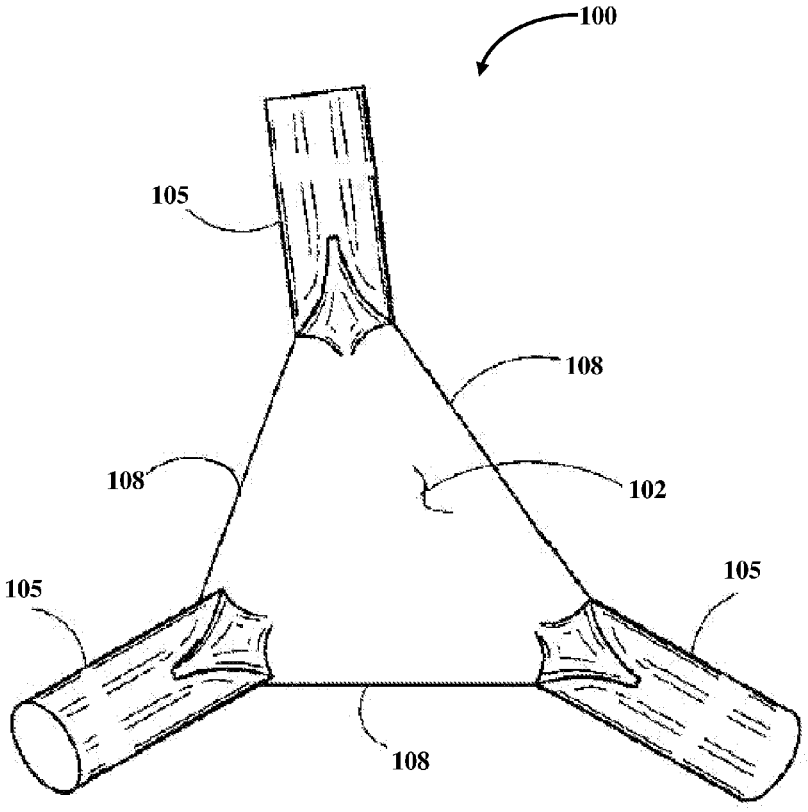
FIG. 13B exemplarily illustrates a right side elevation view of the amphibious protection apparatus prior to inflation of the wall members.
Figure 13C:
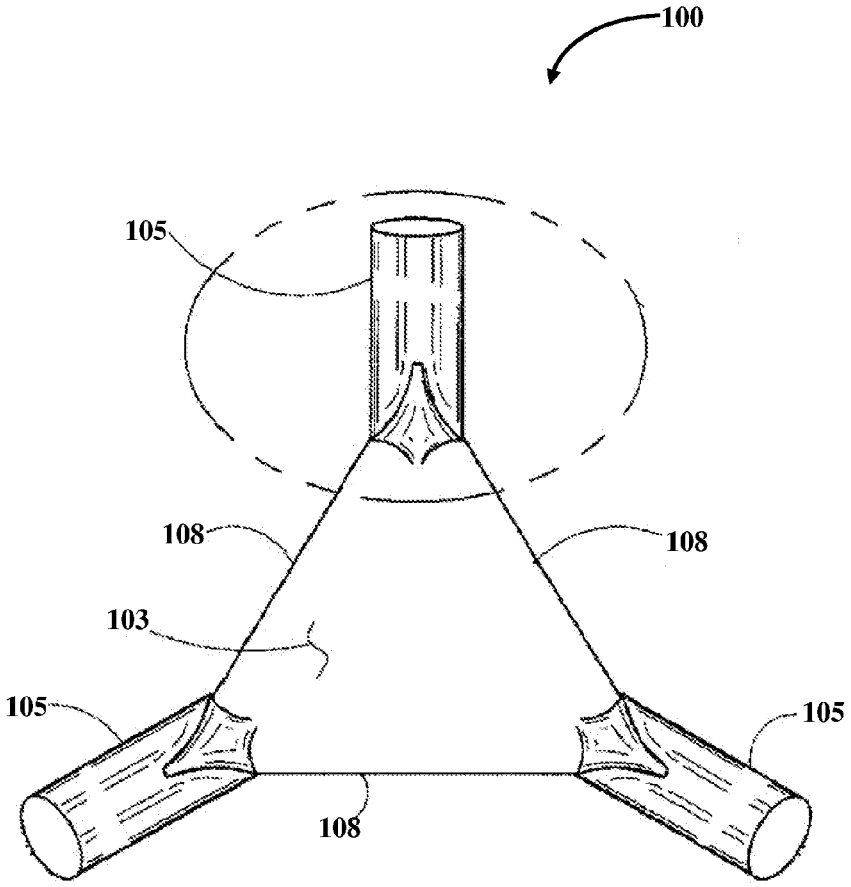
FIG. 13C exemplarily illustrates a front elevation view of the amphibious protection apparatus prior to inflation of the wall members.

FIGS. 13A-13C exemplarily illustrate a plan view, a right side elevation view, and a front elevation view respectively, of the amphibious protection apparatus 100, prior to inflation of the wall members 101, 102, 103, etc. The amphibious protection apparatus 100 disclosed herein is stored for handling and transporting in a deflated and folded configuration as exemplarily illustrated in FIGS. 13A-13C. The amphibious protection apparatus 100 disclosed herein is collapsed into a compact unit for handling and transporting. For usage in a dangerous situation, a user 701 exemplarily illustrated in FIGS. 7-8 and FIG. 15A expands or inflates the wall members 101, 102, 103, etc., of the amphibious protection apparatus 100 from their collapsed or deflated state at the time of use.

The user 701 inflates the wall members 101, 102, 103, and 104 exemplarily illustrated in FIG. 1A, sequentially. Before usage, the wall members 101, 102, 103, and 104 are folded in their collapsed or deflated state. In an example, during operation, the user 701 first inflates the left wall member 101, the right wall member 102, and the bottom wall member 104, which allows the user 701 to enter the occupancy space 110 and to be seated on the seating member 111 as exemplarily illustrated in FIGS. 7-8 and FIG. 15A. The user 701 may then close the front wall member 103 and fasten the front wall member 103 in its collapsed or deflated state using the fasteners 108. Without the tension from inflation, the user 701 can easily fasten the front wall member 103. The user 701 then inflates the front wall member 103 and secures himself/herself within the occupancy space 110 defined by the connected and inflated wall members 101, 102, 103, and 104. After usage, the user 701 deflates the front wall member 103, unfastens the front wall member 103 in its deflated state, exits the amphibious protection apparatus 100, and then deflates the rest of the wall members 101, 102, and 104 and folds them back to their original collapsed or deflated states. The deflation process can be performed, for example, by opening a valve 117 positioned in each of the inflated wall members 101, 102, 103, and 104 as exemplarily illustrated in FIGS. 5-6, from inside the occupancy space 110 to eject the fluid, for example, air out of the enclosed space 118 of each of the wall members 101, 102, 103, and 104.

Figure 13D:
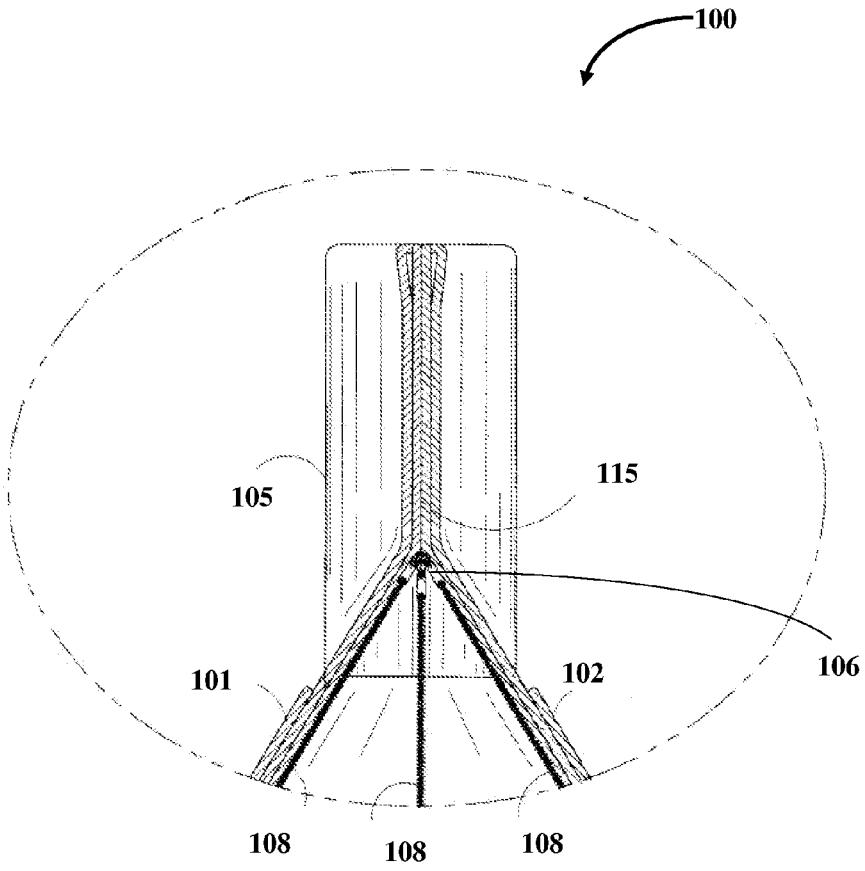
FIG. 13D exemplarily illustrates an enlarged view of an access port of the amphibious protection apparatus prior to inflation of the wall members.

FIG. 13D exemplarily illustrates an enlarged view of an access port 105 of the amphibious protection apparatus 100, prior to inflation of the wall members 101, 102, 103, and 104. The access port 105 positioned at the vertex 106 where at least three of the wall members 101, 102, 103, and 104 meet is disclosed in the detailed description of FIG. 10.

Figure 14A:
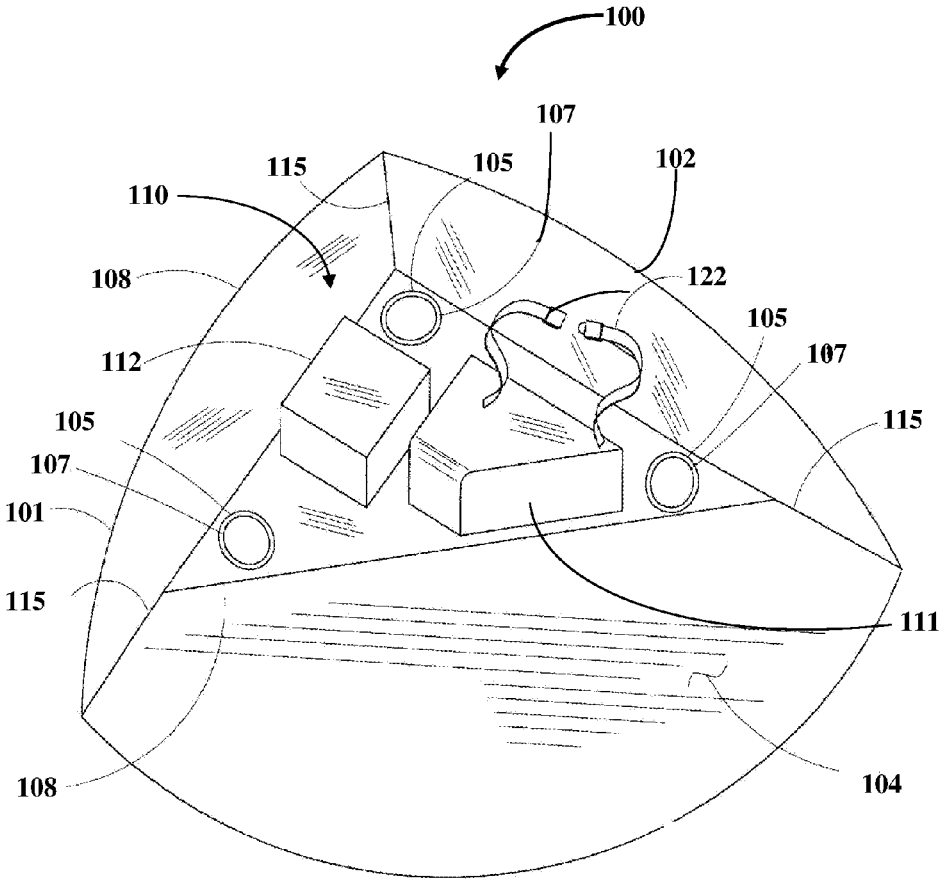
FIG. 14A exemplarily illustrates a cutaway view of the amphibious protection apparatus, showing an occupancy space defined by the detachably connected wall members.
Figure 14B:
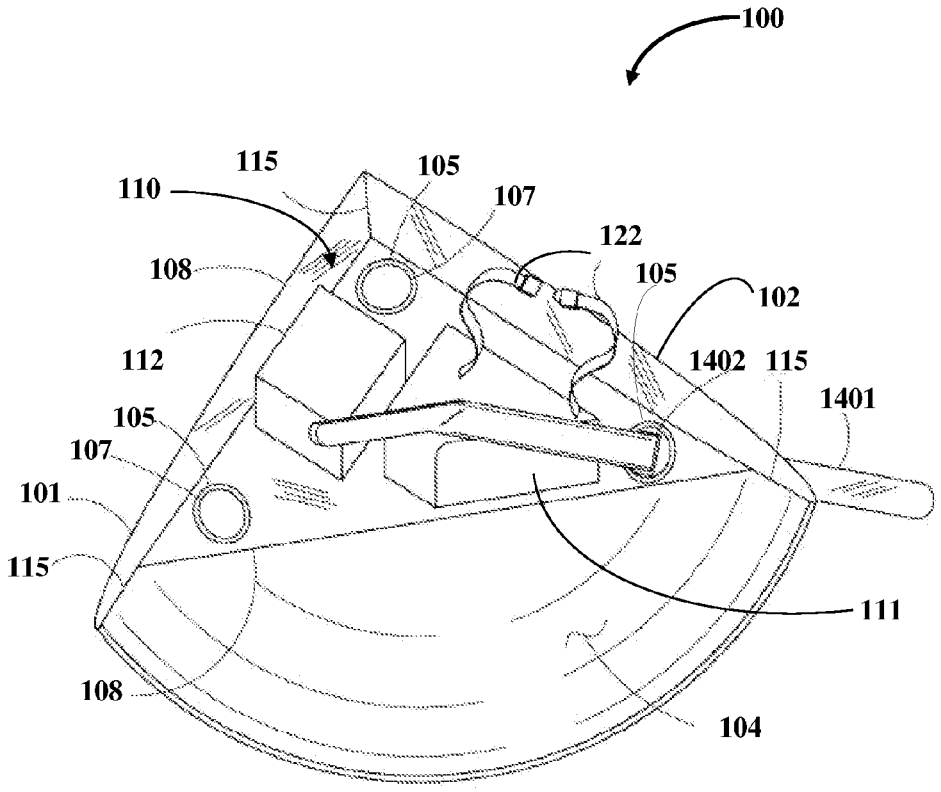
FIG. 14B exemplarily illustrates a cutaway view of an embodiment of the amphibious protection apparatus, showing a navigation member inserted into one of the access ports.

FIGS. 14A-14B exemplarily illustrate cutaway views of the amphibious protection apparatus 100, showing the occupancy space 110 defined by the detachably connected wall members 101, 102, 103, and 104. In addition to the access ports 105, the cutaway views of the amphibious protection apparatus 100 disclosed herein show a storage compartment 112, a seating member 111, and a restraining system 122. The storage compartment 112 may be provided with storage tie down straps 113 as exemplarily illustrated in FIG. 1C and FIGS. 7-8. As exemplarily illustrated in FIGS. 14A-14B, the storage compartment 112 is connected to the bottom wall member 104 within the occupancy space 110. The storage compartment 112 is configured to store multiple supplies, for example, food supplies, oxygen tanks, a first aid kit, safety equipment, head helmets, etc., that may be utilized during a dangerous situation for providing safety and sustenance to the user 701 accommodated within the occupancy space 110. The seating member 111 rigidly positioned on the bottom wall member 104 within the occupancy space 110 is configured to seat one or more users 701. In another embodiment, the amphibious protection apparatus 100 disclosed herein further comprises a restraining system 122 comprising, for example, seat belts operably connected to the seating member 111. The restraining system 122 is configured to be fastened on a user's 701 body part to secure the user 701 against contact with the wall members 101, 102, 103, and 104. The restraining system 122 secures the user 701 accommodated within the occupancy space 110 and protects the user 701 from contacting the wall members 101, 102, 103, and 104. The restraining system 122 retrains the user 701 on the seating member 111.

In an embodiment as exemplarily illustrated in FIG. 14B, one of the access ports 105 is configured to introduce a navigation member 1401 such as a rudder into the occupancy space 110 for navigating the amphibious protection apparatus 100 on water. The navigation member 1401 is inserted into one of the access ports 105. A rudder bearing 1402 is integrated into each of the access ports 105 for flexibly positioning the navigation member 1401 within each of the access ports 105. The user 701 accommodated within the occupancy space 110 turns or steers the navigation member 1401 through the access port 105 to steer and propel the amphibious protection apparatus 100 in water. In an embodiment, the amphibious protection apparatus 100 contains an oxygen source (not shown), for example, an oxygen air mixture, an oxygen generated canister, or any other apparatus to supply oxygen to the user 701 seated on the seating member 111 within the occupancy space 110 of the amphibious protection apparatus 100. The oxygen source is stored, for example, in the storage compartment 112.

FIGS. 15A-15D exemplarily illustrates different views of an embodiment of the amphibious protection apparatus 100. In this embodiment, inflation of each of the detachably connected wall members 101, 102, 103, and 104 forms a buoyant enclosure 114 of a spherical configuration configured to bounce on land and float on water as exemplarily illustrated in FIGS. 15A-15D. A front elevation view of this embodiment of the amphibious protection apparatus 100, showing an open access region 109 is exemplarily illustrated in FIG. 15A. A front elevation view of this embodiment of the amphibious protection apparatus 100, showing a closed access region 109 is exemplarily illustrated in FIG. 15B. A right side elevation view of this embodiment of the amphibious protection apparatus 100 is exemplarily illustrated in FIG. 15C. A plan view of this embodiment of the amphibious protection apparatus 100 is exemplarily illustrated in FIG. 15D.

In an embodiment, the amphibious protection apparatus 100 exemplarily illustrated in FIGS. 3A-3B, FIG. 4B, FIGS. 7-9, FIGS. 11-12, FIGS. 15A-15D, and FIG. 17 further comprises a rescue identifier, for example, a bright color such as orange, red, etc., an array of lights, audio indicators such as whistles, etc., provided on the external surfaces 101*a*, 102*a*, 103*c*, and 104*a* of the wall members 101, 102, 103, and 104 respectively. The rescue identifier is configured for easy identification by rescuers.

Figure 15A:
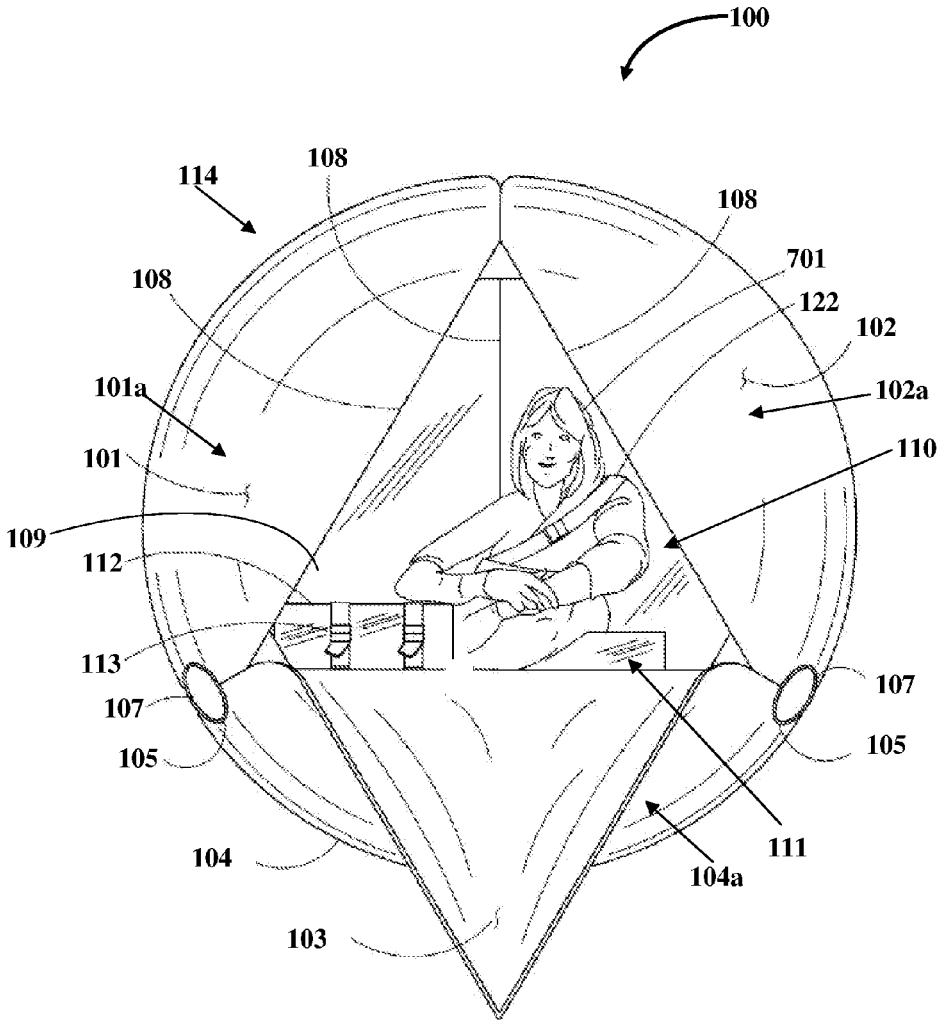
FIG. 15A exemplarily illustrates a front elevation view of an embodiment of the amphibious protection apparatus, showing an open access region.
Figure 15B:
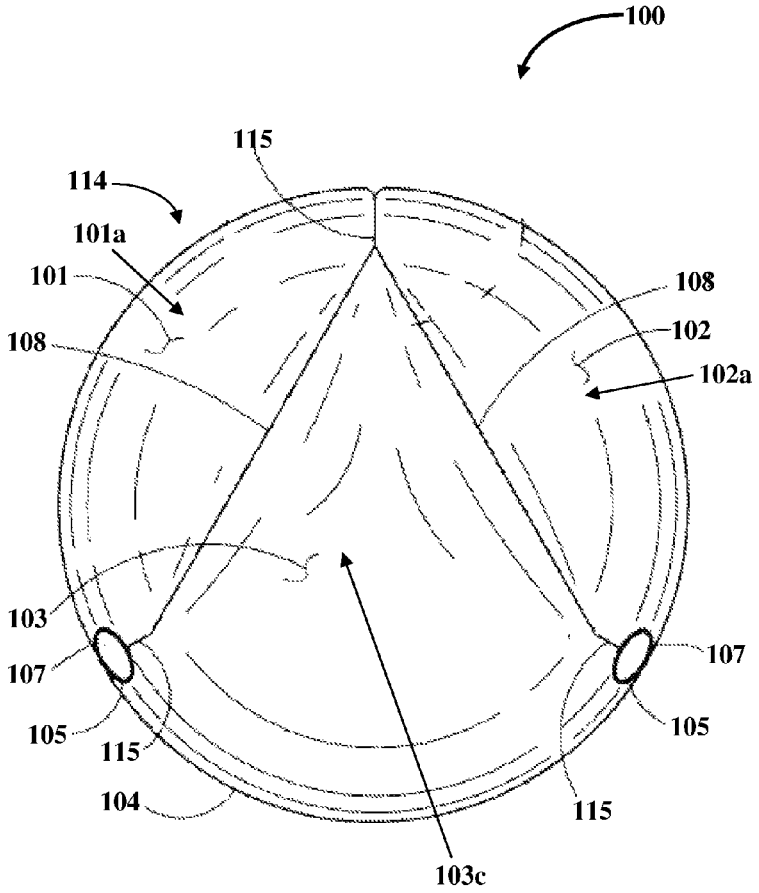
FIG. 15B exemplarily illustrates a front elevation view of the embodiment of the amphibious protection apparatus shown in FIG. 15A, showing a closed access region.
Figure 15C:
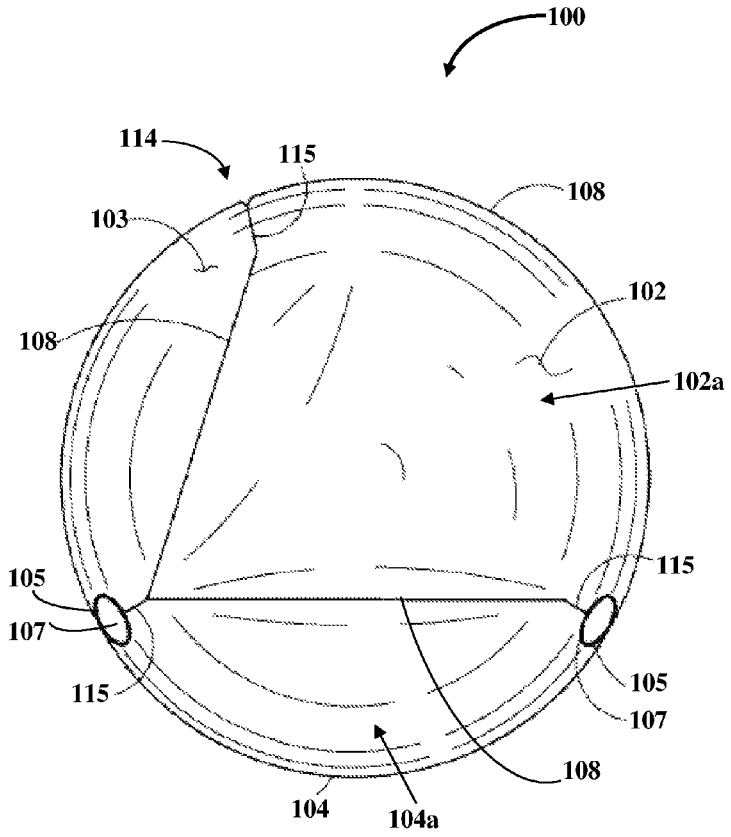
FIG. 15C exemplarily illustrates a right side elevation view of the embodiment of the amphibious protection apparatus shown in FIG. 15A.
Figure 15D:
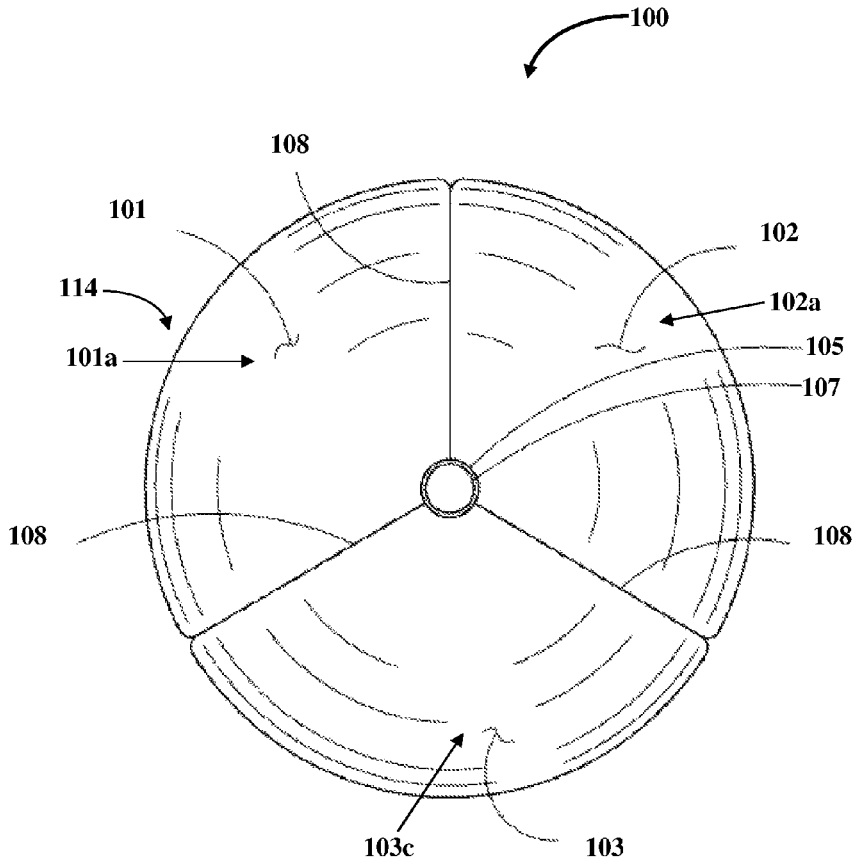
FIG. 15D exemplarily illustrates a plan view of the embodiment of the amphibious protection apparatus shown in FIG. 15A.
Figure 16:
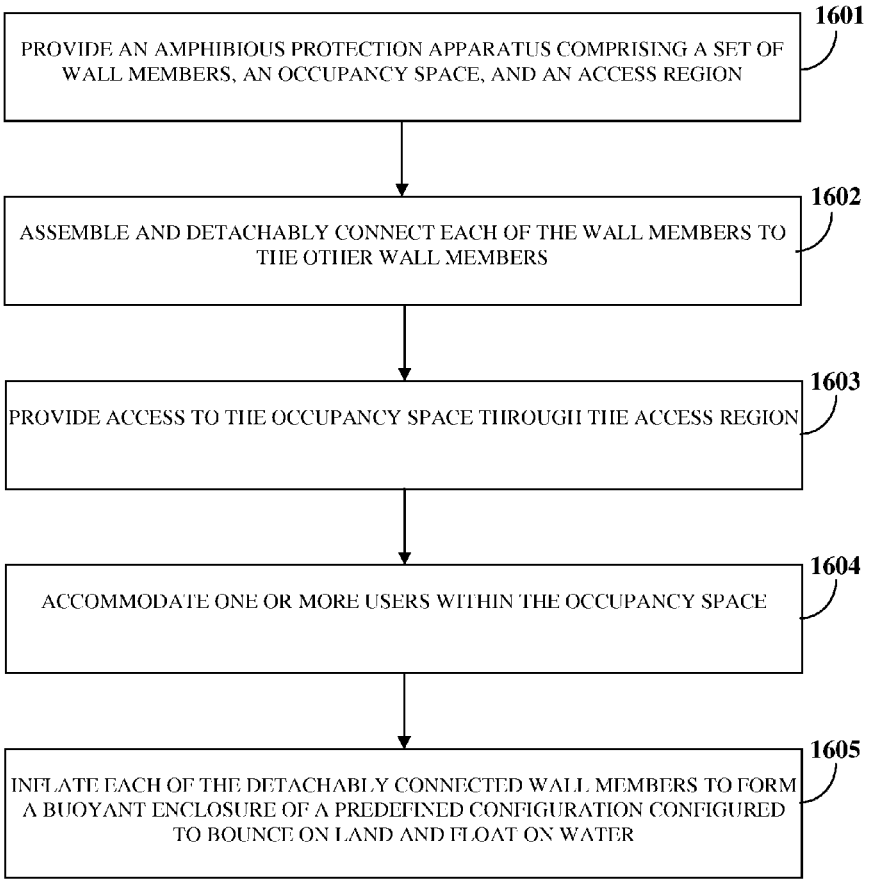
FIG. 16 illustrates a method for providing safety to one or more users from impacts from different directions on land and water.

FIG. 16 illustrates a method for providing safety to one or more users 701 from impacts from different directions on land and water. The method disclosed herein provides 1601 the amphibious protection apparatus 100 comprising a set of wall members 101, 102, 103, and 104, an occupancy space 110, and an access region 109 as disclosed in the detailed description of FIGS. 1-15D. Each of the wall members 101, 102, 103, and 104 is assembled and detachably connected 1602 to the other wall members 101, 102, 103, and 104. The amphibious protection apparatus 100 provides 1603 a user 701 with access to the occupancy space 110 through the access region 109. The amphibious protection apparatus 100 accommodates 1604 one or more users 701 within the occupancy space 110.

The user 701 accommodated within the occupancy space 110 inflates 1605 each of the detachably connected wall members 101, 102, 103, and 104, for example, by injecting a fluid such as air into the enclosed space 118 of each of the detachably connected wall members 101, 102, 103, and 104 via the valve 117 in each of the wall members 101, 102, 103, and 104 using an inflation unit 120 contained within the enclosed space 118 as exemplarily illustrated in FIG. 6, an air pump (not shown), an internal air inflation system (not shown), or tubes (not shown) as disclosed in the detailed description of FIG. 6. Inflation of each of the detachably connected wall members 101, 102, 103, and 104 forms a buoyant enclosure 114 of a predefined configuration, for example, a polyhedral configuration as exemplarily illustrated in FIGS. 3A-3B, FIG. 4B, FIGS. 7-9, FIGS. 11-12, and FIG. 17, a spherical configuration as exemplarily illustrated in FIGS. 15A-15D, etc., that is configured to bounce on land and float on water. The buoyant enclosure 114 encloses the accommodated users 701 within the occupancy space 110 to protect the accommodated users 701 from impacts from different directions on land and water, thereby providing safety to the accommodated users 701 on land and water. The wall members 101, 102, 103, and 104 are configured to resist impact on contact of the amphibious protection apparatus 100 with external objects, for example, while the amphibious protection apparatus 100 floats on a surface of water. After usage, a user 701 can deflate the wall members 101, 102, 103, and 104 and fold the wall members 101, 102, 103, and 104 over each other into a compact unit for storage.

Figure 17:
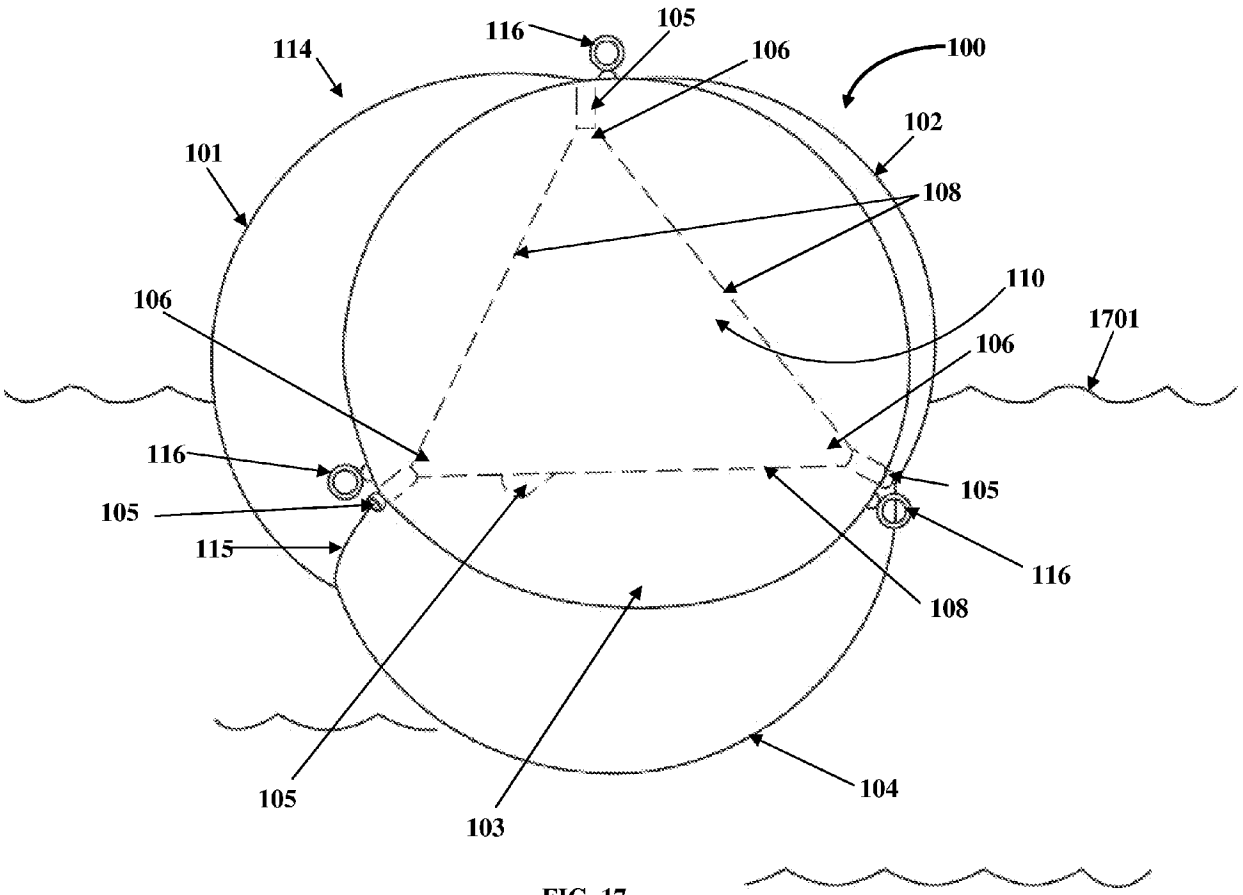
FIG. 17 exemplarily illustrates an application of the amphibious protection apparatus on water.

FIG. 17 exemplarily illustrates an application of the amphibious protection apparatus 100 on water 1701. Consider an example of a situation of a natural calamity in water 1701 such as a tsunami, a flash flood, etc, where the user 701 requires an apparatus that provides safety. The user 701 employs the amphibious protection apparatus 100 disclosed herein for personal protection. The user 701 unfolds the amphibious protection apparatus 100 from its deflated or collapsed state and assembles the amphibious protection apparatus 100. The user 701 fastens the wall members 101, 102, and 104 using the fasteners 108 provided at the peripheries, for example, 101*b*, 102*b*, etc., exemplarily illustrated in FIG. 10, of each of the wall members 101, 102, and 104. The user 701 then inflates the wall members 101, 102, and 104 of the amphibious protection apparatus 100 manually using a pump (not shown) or using the inflation unit 120 operably connected to the valve 117 on each of the wall members 101, 102, and 104 exemplarily illustrated in FIG. 6. The user 701 enters the occupancy space 110 of the amphibious protection apparatus 100 through the access region 109 defined by opening the front wall member 103 in its collapsed state. The user 701 then inflates the front wall member 103 and fastens the front wall member 103 to the side wall members 101 and 102, thereby forming the buoyant enclosure 114 that floats on water 1701.

The user 701 then sits on the seating member 111 rigidly positioned on the bottom wall member 104 as exemplarily illustrated in FIGS. 7-8 and FIG. 15A. The user 701 then fastens the restraining system 122 having, for example, a safety belt around the user's 701 body to secure himself/herself to the seating member 111 within the occupancy space 110 and to avoid contact with the wall members 101, 102, 103, and 104, and then secures his/her head using head gear such as a helmet stored in the storage compartment 112 rigidly positioned on the bottom wall member 104. The user 701 inserts a navigation member 1401 such as a rudder through the access port 105 positioned at the vertex 106 where at least three of the wall members 101, 102, 103, and 104 meet as exemplarily illustrated in FIG. 14B, to navigate the amphibious protection apparatus 100 in water 1701. The user 701 uses the viewing members 119*a* and 119*b* configured as sealed transparent windows provided, for example, on the front wall member 103 of the amphibious protection apparatus 100 as exemplarily illustrated in FIG. 6, for visualization during navigation on water 1701. Since the user 701 is completed enclosed within the buoyant enclosure 114 formed by the inflation of each of the detachably connected wall members 101, 102, 103, and 104, the amphibious protection apparatus 100 disclosed herein protects the user 701 accommodated within the occupancy space 110 from impacts from different directions in water 1701, thereby providing safety to the accommodated user 701 in water 1701. The amphibious protection apparatus 100 disclosed herein floats over water 1701, resists sharp and heavy impacts, and can flow smoothly over fast moving water 1701, and prevent the user 701 from drowning or from blunt trauma.

Consider another example where a user 701 is trapped at a high elevated location such as a high floor level of a high rise building engulfed by fire, where the user 701 requires an apparatus that provides safety. The user 701 employs the amphibious protection apparatus 100 disclosed herein for personal protection while escaping from the building by jumping from the high floor level to the ground. The user 701 unfolds and assembles the wall members 101, 102, 103, and 104 of the amphibious protection apparatus 100. The user 701 then inflates the wall members 101, 102, and 104 of the amphibious protection apparatus 100. The user 701 enters the occupancy space 110 of the amphibious protection apparatus 100 through the access region 109 defined by opening the front wall member 103 in its collapsed state. The user 701 then fastens the front wall member 103 to the side wall members 101 and 102, inflates the front wall member 103, sits on the seating member 111 rigidly positioned on the bottom wall member 104, fastens the restraining system 122 having, for example, a safety belt around the his/her body to secure himself/herself to the seating member 111 within the occupancy space 110 and to avoid contact with the wall members 101, 102, 103, and 104, and then secures the user's 701 head using head gear such as a helmet stored in the storage compartment 112 rigidly positioned on the bottom wall member 104.

The user 701 is now enclosed inside the occupancy space 110 surrounded by the inflated wall members 101, 102, 103, and 104. Since the user 701 is completely enclosed within the buoyant enclosure 114 formed by each of the detachably connected and inflated wall members 101, 102, 103, and 104, the amphibious protection apparatus 100 protects the user 701 accommodated within the occupancy space 110 from impacts from all directions during a free fall from the high floor level to the ground below, thereby providing safety to the accommodated user 701 during the fall to the ground. The amphibious protection apparatus 100 disclosed herein can also be used to protect the user 701 from falling from an airplane, a mountain, and other high elevated locations. The structure, volume, and weight of the amphibious protection apparatus 100 relative to its size are configured to lower the speed with which the amphibious protection apparatus 100 falls from an elevated location.

In an embodiment, the amphibious protection apparatus 100 also provides protection during extreme sporting activities, for example, white water rafting which encounter rapid speed and fluid or solid impacts. The amphibious protection apparatus 100 can be used in situations such as unexpected flash urban flooding. The user 701 expands the left wall member 101, the right wall member 102, the bottom wall member 104, and the open front wall member 103. The expansion is accomplished in any manner effective to expand the amphibious protection apparatus 100. The amphibious protection apparatus 100 provides a multipurpose function whereby it is contemplated that a life is saved because the amphibious protection apparatus 100 is not only buoyant, but while on water 1701, the amphibious protection apparatus 100 would bounce off any articles encountered, for example, during a flood situation.

For purposes of illustration, the detailed description refers to accommodation of a seating member 111, a restraining system 122, storage compartments 112, oxygen sources, supplies, etc., within the occupancy space 110 of the amphibious protection apparatus 100; however the scope of the amphibious protection apparatus 100 disclosed herein may be extended to accommodate any other equipment and supplies required for safety.

Figure 18:
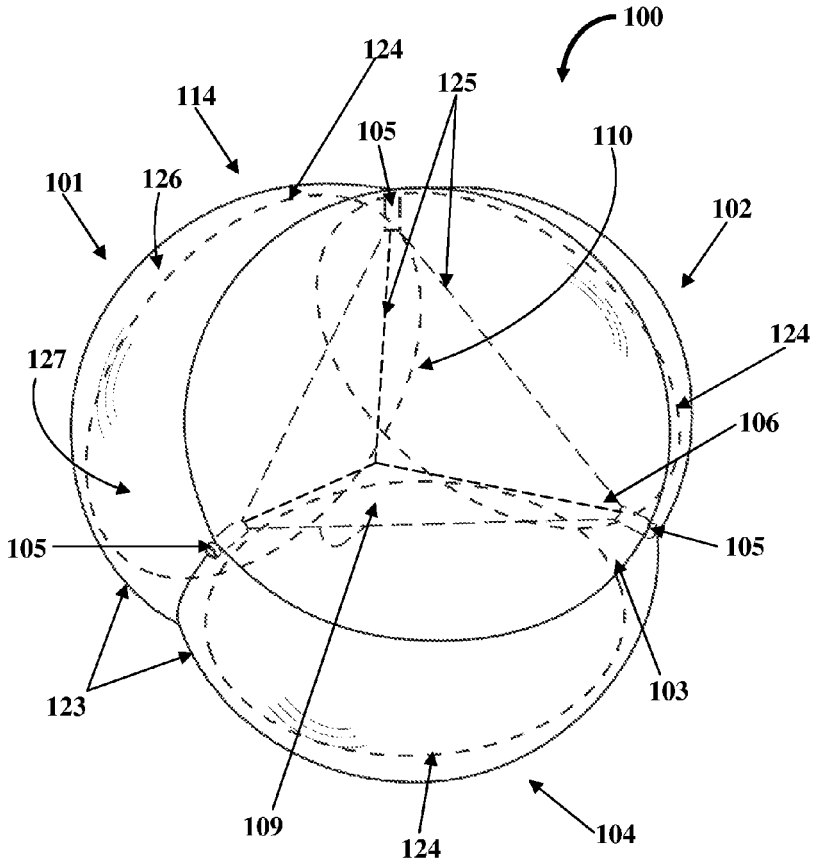
FIG. 18 exemplarily illustrates a front perspective view of an embodiment of the amphibious protection apparatus.

FIG. 18 exemplarily illustrates a front perspective view of an embodiment of the amphibious protection apparatus 100. The amphibious protection apparatus 100 disclosed herein provides safety from impacts from different directions on land and water to one or more users 701 exemplarily illustrated in FIGS. 7-8 and FIG. 15A. The amphibious protection apparatus 100 disclosed herein comprises a set of wall members 101, 102, 103, and 104, an occupancy space 110, and an access region 109. Each wall member, for example, 103 is foldably and detachably connected to another wall member, for example, 101, 102, and 104. Each wall member, for example, 101 comprises an outer layer 123 of a predetermined thickness and an inner inflatable member 124 as disclosed in the detailed description of FIG. 19. The outer layer 123 of each wall member 101 is made of a flexible and impact resistant material, for example, a strong resilient rubber, a nylon coated material, a silicone coated material, a thick fabric material, etc., to absorb shock and cushion the accommodated users 701 from impact of external objects. The outer layer 123 is not airtight but strong and resilient against pressure from air to form into a predetermined shape when inflated. The thickness of the outer layer 123 of each wall member 101 is based on the type of material used to enable the wall member 101 to withstand repetitive external forces and impacts from different directions. For example, if the outer layer 123 is made of a resilient rubber material that can withstand repetitive external force, the thickness of the outer layer 123 is selected, for example, within a range of about 4 mm to about 10 mm. The inner inflatable member 124 is, for example, a round balloon shaped bladder and is expandable.

Figure 19:
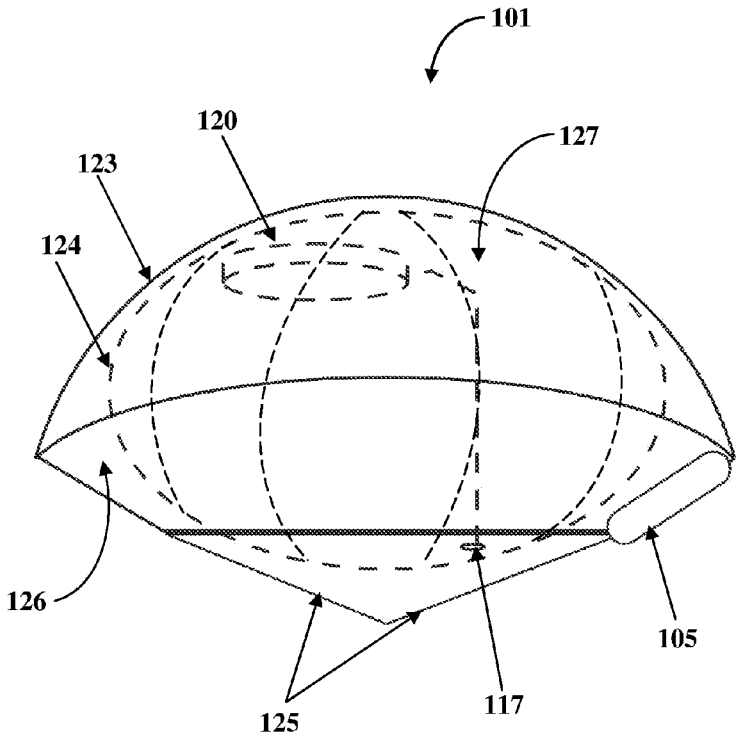
FIG. 19 exemplarily illustrates a perspective view of a wall member of the embodiment of the amphibious protection apparatus shown in FIG. 18.

FIG. 19 exemplarily illustrates a perspective view of a wall member 101 of the embodiment of the amphibious protection apparatus 100 shown in FIG. 18. The outer layer 123 of each wall member 101 defines a wall periphery 125. The wall periphery 125 of the outer layer 123 of each wall member, for example, 101 is connected to the wall periphery 125 of the outer layer 123 of another wall member, for example, 104 as exemplarily illustrated in FIG. 18. In an embodiment, the amphibious protection apparatus 100 disclosed herein further comprises a fastener 108 as exemplarily illustrated in FIG. 10, connected at the wall periphery 125 of the outer layer 123 of each wall member 101. The fastener 108 attaches and detaches each wall member 101. The fastener 108 is, for example, a zipper, a hook and loop fastener, etc. The outer layer 123 of each wall member 101 defines an outer enclosed space 126. The outer enclosed space 126 accommodates the inner inflatable member 124. The inner inflatable member 124 comprises an inner enclosed space 127. A fluid, for example, air injected into the inner enclosed space 127 of the inner inflatable member 124 inflates the inner inflatable member 124. The inflation of the inner inflatable member 124 of each of the detachably connected wall members 101, 102, 103, and 104 forms a buoyant enclosure 114 as exemplarily illustrated in FIG. 18. The buoyant enclosure 114 is of a predefined configuration, for example, a polyhedral configuration, a cubic configuration, a cuboidal configuration, a spherical configuration, etc., and is configured to bounce on land and float on water 1701 as exemplarily illustrated in FIG. 17.

The detachably connected wall members 101, 102, 103, and 104 define the occupancy space 110. The occupancy space 110 accommodates one or more users 701 as exemplarily illustrated in FIGS. 7-8 and FIG. 15A. The buoyant enclosure 114 formed by the inflation of the inner inflatable member 124 of each of the detachably connected wall members 101, 102, 103, and 104 protects the accommodated users 701 from impacts from different directions on land and water 1701. The access region 109 is defined by opening one of the detachably connected wall members 101, 102, 103, and 104 as exemplarily illustrated in FIG. 1C, FIGS. 7-8, and FIG. 15A. The access region 109 provides access to the occupancy space 110.

In an embodiment, the amphibious protection apparatus 100 disclosed herein further comprises an inflation unit 120 operably connected to each wall member 101. The inflation unit 120 injects the fluid into the inner enclosed space 127 of the inner inflatable member 124 of each wall member 101 to instantly inflate each wall member 101. In an embodiment, the amphibious protection apparatus 100 disclosed herein further comprises a valve 117 operably positioned on each wall member 101. The valve 117 injects the fluid into and ejects the fluid out of the inner enclosed space 127 of the inner inflatable member 124 of each wall member 101 for inflation and deflation of each wall member 101.

Figure 20A:
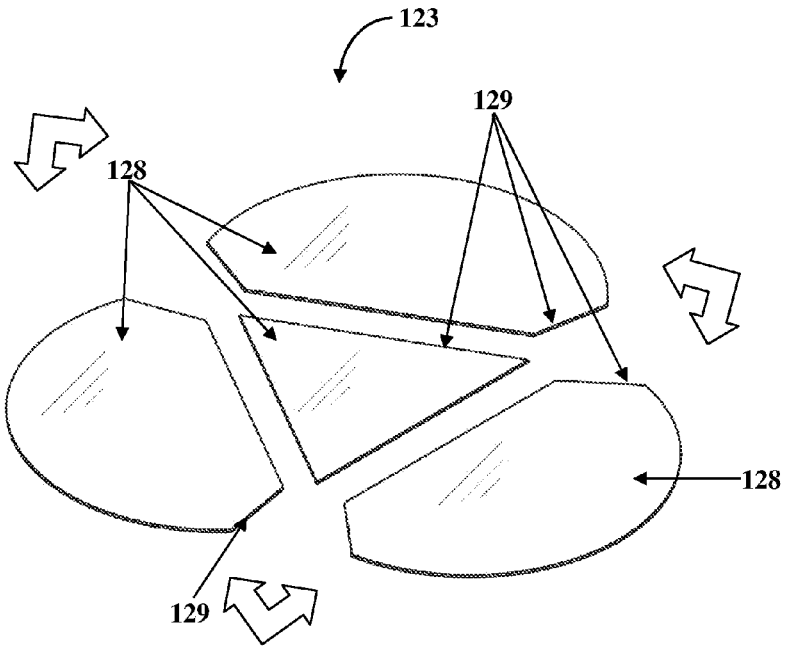
FIG. 20A exemplarily illustrates a top perspective view of multiple material segments forming an outer layer of a wall member of the embodiment of the amphibious protection apparatus.
Figure 20B:
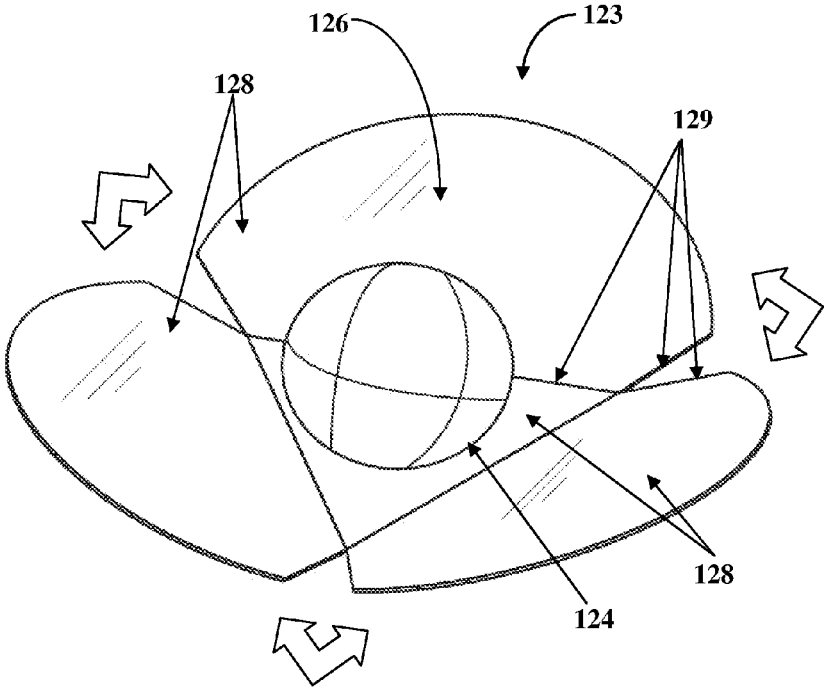
FIG. 20B exemplarily illustrates a front perspective view of an inner inflatable member positioned within an outer enclosed space of the outer layer to form the wall member of the embodiment of the amphibious protection apparatus.

FIGS. 20A-20B exemplarily illustrate perspective views of multiple material segments 128 forming an outer layer 123 of a wall member 101 exemplarily illustrated in FIG. 19. As used herein, the phrase "material segments" refers to elemental portions or cut pieces of a fabrication material which are fastened or sutured at their respective edges or peripheries to manufacture the outer layer 123 or the inner inflatable member 124 of the wall member 101. A top perspective view of the material segments 128 forming the outer layer 123 of the wall member 101 of the embodiment of the amphibious protection apparatus 100 is exemplarily illustrated in FIG. 20A. A front perspective view of an inner inflatable member 124 positioned within an outer enclosed space 126 of the outer layer 123 to form the wall member 101 of the embodiment of the amphibious protection apparatus 100 is exemplarily illustrated in FIG. 20B. In this embodiment, the outer layer 123 of each wall member 101 comprises multiple material segments 128 of predefined shapes. Each material segment 128 of the outer layer 123 defines a segment periphery 129. The segment periphery 129 of each material segment 128 is fastened to the segment periphery 129 of another material segment 128 as indicated by the arrows to form the outer enclosed space 126 as exemplarily illustrated in FIG. 20B, for the accommodation and the inflation of the inner inflatable member 124. The segment periphery 129 of each material segment 128 is, for example, sutured with strong nylon fiber or connected using a zipper that can be opened and closed as needed.

Figure 21A:
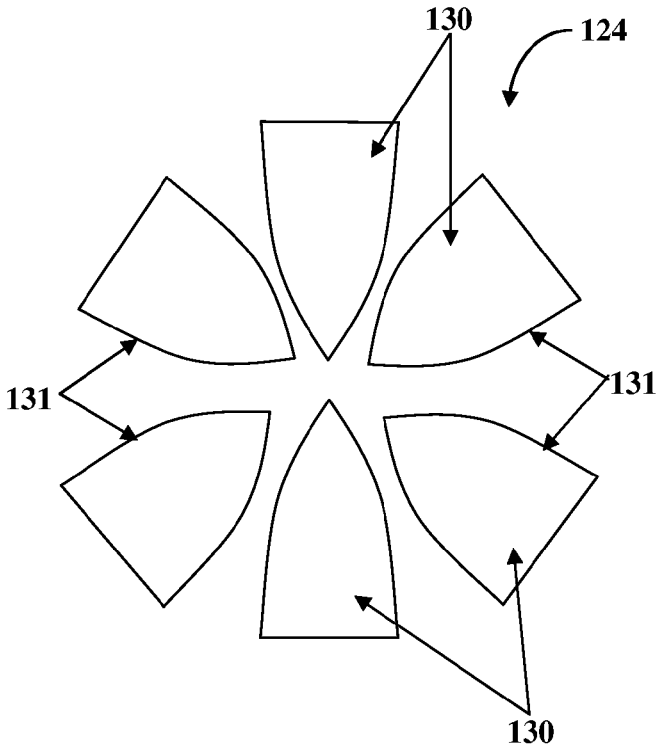
FIG. 21A exemplarily illustrates a top view of multiple material segments forming an inner inflatable member of a wall member of the embodiment of the amphibious protection apparatus.
Figure 21B:
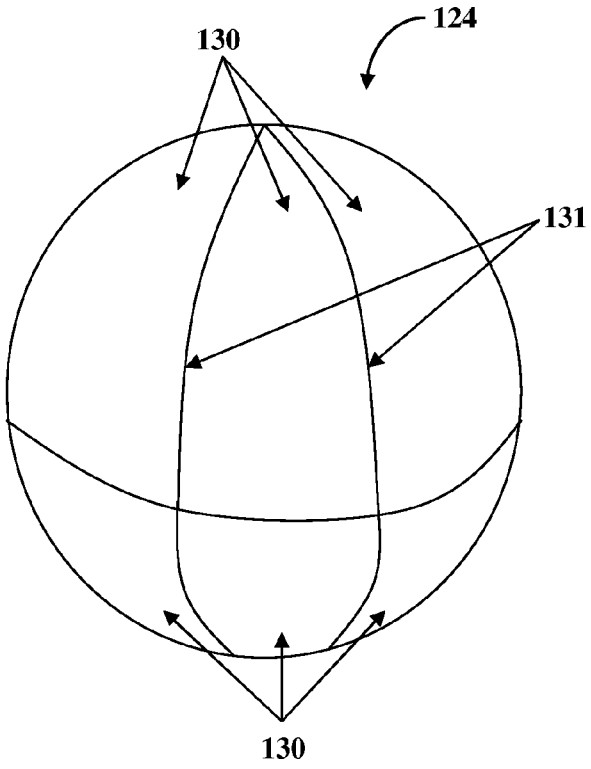
FIG. 21B exemplarily illustrates a front perspective view of an inner inflatable member of a wall member of the embodiment of the amphibious protection apparatus, formed by multiple material segments.

FIG. 21A exemplarily illustrates a top view of multiple material segments 130 forming an inner inflatable member 124 of a wall member 101 of the embodiment of the amphibious protection apparatus 100. The inner inflatable member 124 of each wall member 101 is airtight and conforms to a shape defined by the outer layer 123 of each wall member 101 when inflated. In an embodiment, the inner inflatable member 124 of each wall member 101 comprises multiple material segments 130 of predefined shapes, for example, curved triangle shapes as exemplarily illustrated in FIG. 21A. Each material segment 130 of the inner inflatable member 124 defines a segment periphery 131. The segment periphery 131 of each material segment 130 is fastened to the segment periphery 131 of another material segment 130 as exemplarily illustrated in FIG. 21B, to form the inner enclosed space 127 for receiving the fluid injected into the inner inflatable member 124. The segment periphery 131 of each material segment 130 is, for example, sutured with strong nylon fiber or connected using a zipper that can be opened and closed as needed. A front perspective view of the inner inflatable member 124 of a wall member 101 of the embodiment of the amphibious protection apparatus 100, formed by multiple material segments 130 is exemplarily illustrated in FIG. 21B.

Figure 21C:
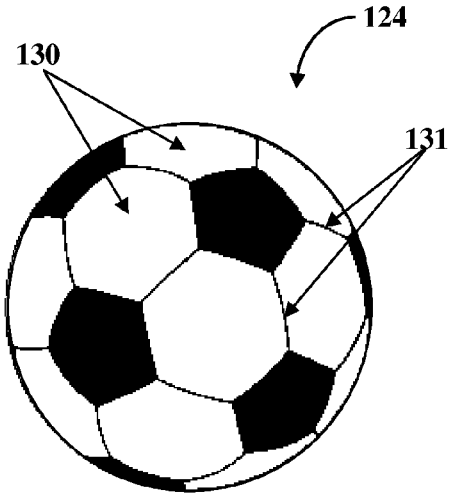
FIG. 21C exemplarily illustrates a front perspective view of an inner inflatable member of the embodiment of the amphibious protection apparatus, having the shape of a soccer ball.

FIG. 21C exemplarily illustrates a front perspective view of an inner inflatable member 124 of the embodiment of the amphibious protection apparatus 100, having the shape of a soccer ball. The material segments 130 may be of predefined shapes, for example, pentagon shapes, hexagon shapes, etc. These material segments 130 are fastened via their segment peripheries 131 to form a soccer ball shaped inner inflatable member 124 when inflated as exemplarily illustrated in FIG. 21C.

Figures 22A, 22B:
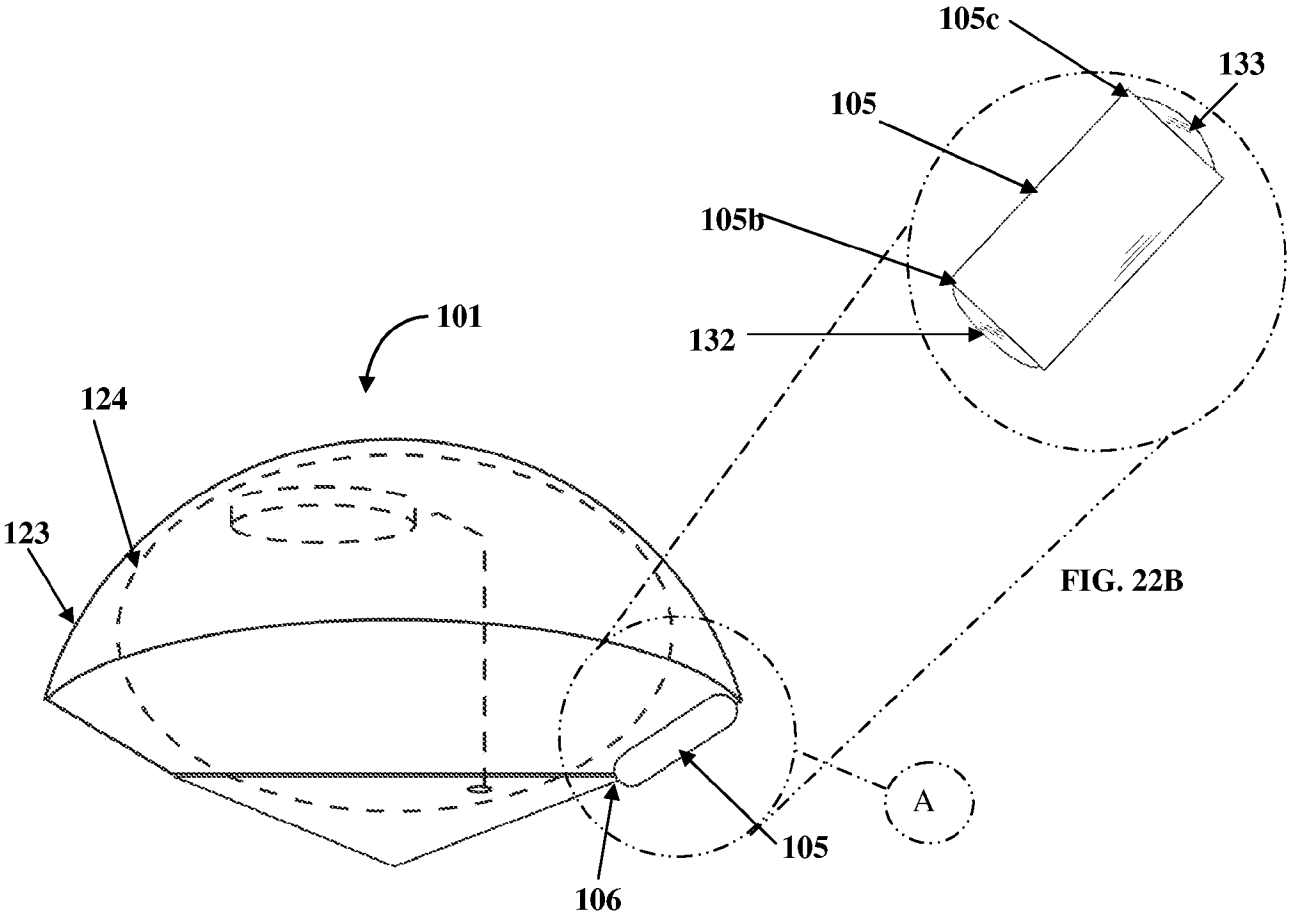
FIG. 22A exemplarily illustrates a perspective view of a wall member of another embodiment of the amphibious protection apparatus, showing an access port.
FIG. 22B exemplarily illustrates an enlarged view of the access port marked by a portion A in FIG. 22A, showing an arrangement of a double convex lens and a convexo concave lens at the opposing ends of the access port.

FIG. 22A exemplarily illustrates a perspective view of a wall member 101 of another embodiment of the amphibious protection apparatus 100, showing an access port 105. FIG. 22B exemplarily illustrates an enlarged view of the access port 105 marked by a portion A in FIG. 22A, showing an arrangement of a double convex lens 132 and a convexo concave lens 133 at the opposing ends 105*b* and 105*c* of the access port 105. The access port 105 is positioned at a vertex 106 where at least three of the wall members, for example, 103, and 104 meet, as exemplarily illustrated in FIGS. 1A-1C.

Figure 23:
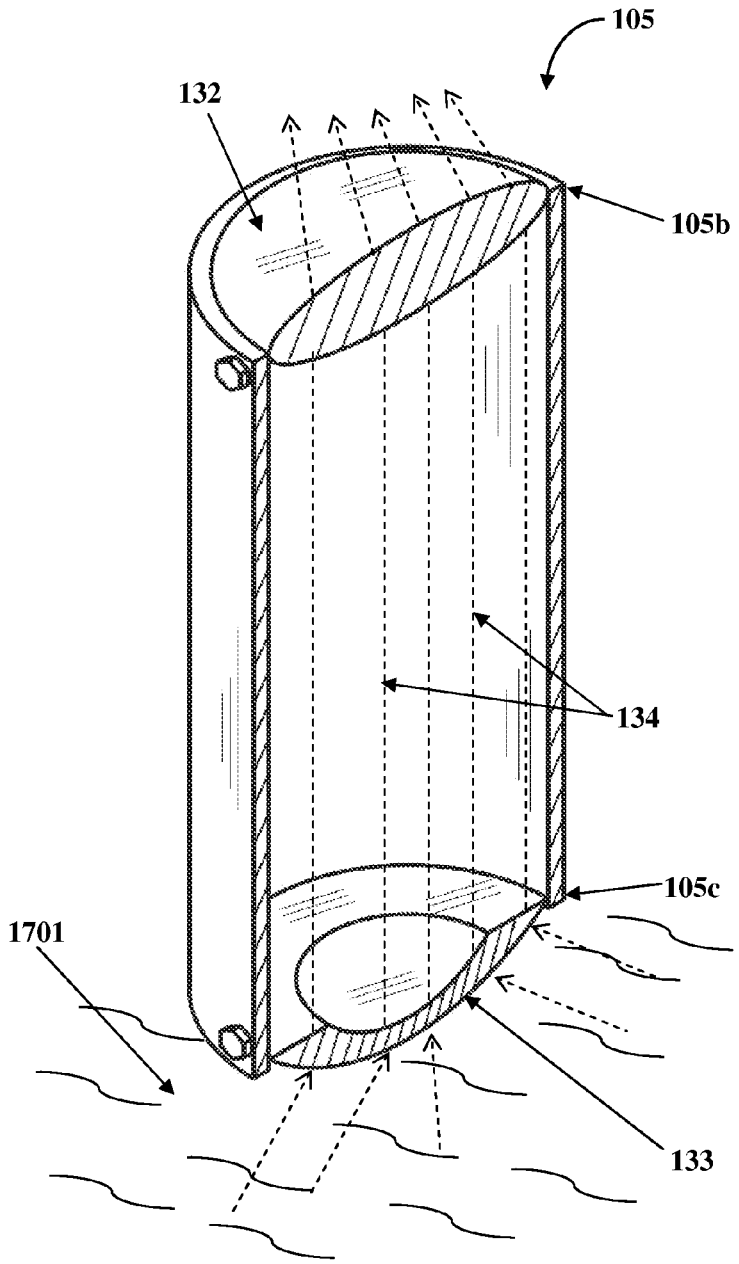
FIG. 23 exemplarily illustrates an isometric sectional view of the access port of the embodiment of the amphibious protection apparatus, showing the arrangement of the double convex lens and the convexo concave lens at the opposing ends of the access port.

FIG. 23 exemplarily illustrates an isometric sectional view of the access port 105 of the embodiment of the amphibious protection apparatus 100, showing the arrangement of the double convex lens 132 and the convexo concave lens 133 at the opposing ends 105*b* and 105*c* of the access port 105. In this embodiment, the amphibious protection apparatus 100 disclosed herein further comprises the double convex lens 132 positioned at one end 105*b* of the access port 105 that is proximal to the occupancy space 110 exemplarily illustrated in FIG. 18, and a convexo concave lens 133 positioned at a distal end 105*c* of the access port 105 that is exposed to an external environment, for example, water 1701. The convexo concave lens 133 can be used to maximize viewing of the external environment. The arrangement of the double convex lens 132 and the convexo concave lens 133 magnifies external objects, for example, trees, barriers such as rocks, walls, etc., present in the external environment. Light rays 134 from water 1701 reflected from the trees or rocks are converged through the convexo concave lens 133. The double convex lens 132 receives the light rays 134 and further converges the light rays 134 so that a user 701 can view the objects through the double convex lens 132, for example, a magnifying lens. The double convex lens 132 can be used inside to enhance viewing of the external environment. The double convex lens 132 and the convexo concave lens 133 are, for example, made of plastic. In an embodiment, the double convex lens 132 and the convexo concave lens 133 also preclude entry of foreign objects, for example, elements external to the occupancy space 110 such as pebbles or rocks, waste matter, etc., into the occupancy space 110 through the access port 105.

Figure 24:
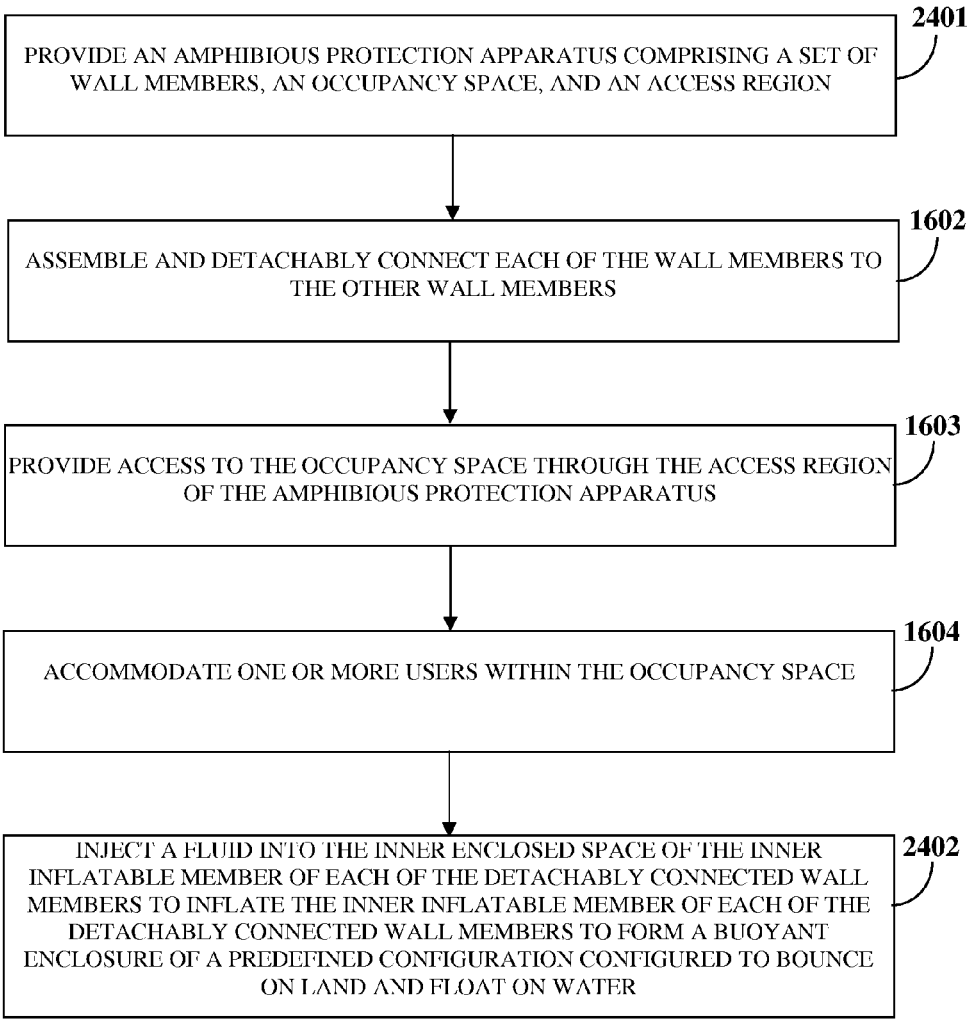
FIG. 24 exemplarily illustrates an embodiment of the method for providing safety to one or more users from impacts from different directions on land and water using the embodiment of the amphibious protection apparatus shown in FIG. 18.

FIG. 24 exemplarily illustrates an embodiment of the method for providing safety to one or more users 701 exemplarily illustrated in FIGS. 7-8, from impacts from different directions on land and water using the embodiment of the amphibious protection apparatus 100 shown in FIG. 18. The amphibious protection apparatus 100 comprising a set of wall members 101, 102, 103, and 104, an occupancy space 110, and an access region 109 as disclosed in the detailed description of FIGS. 18-19 is provided 2401. Each of the wall members 101, 102, 103, and 104 is assembled and detachably connected 1602 to the other wall members 101, 102, 103, and 104. The amphibious protection apparatus 100 disclosed herein provides 1603 one or more users 701 with access to the occupancy space 110 through the access region 109. The amphibious protection apparatus 100 accommodates 1604 one or more users 701 within the occupancy space 110. A user 701 actuates the inflation unit 120, causing the inflation unit 120 to inject 2402 a fluid into the inner enclosed space 127 of the inner inflatable member 124 of each of the detachably connected wall members 101, 102, 103, and 104 to inflate the inner inflatable member 124 of each of the detachably connected wall members 101, 102, 103, and 104 to form a buoyant enclosure 114 of a predefined configuration configured to bounce on land and float on water 1701 as exemplarily illustrated in FIG. 17. The buoyant enclosure 114 encloses the accommodated users 701 within the occupancy space 110 to protect the accommodated users 701 from impacts from different directions on land and water 1701, thereby providing safety to the accommodated users 701 on land and water 1701.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

We claim:

1. An amphibious protection apparatus for providing safety to one or more users from impacts from different directions on land and water, said amphibious protection apparatus comprising:

a set of wall members, each of said wall members being foldably and detachably connected to another of said wall members, said each of said wall members comprising an outer layer of a predetermined thickness and an inner inflatable member, said outer layer of said each of said wall members defining a wall periphery, said wall periphery of said outer layer of said each of said wall members connected to said wall periphery of said outer layer of another of said wall members, said outer layer of said each of said wall members defining an outer enclosed space, said outer enclosed space configured to accommodate said inner inflatable member comprising an inner enclosed space, said inner inflatable member configured to be inflated by a fluid injected into said inner enclosed space of said inner inflatable member, wherein said inflation of said inner inflatable member of each of said detachably connected wall members forms a buoyant enclosure of a predefined configuration configured to bounce on said land and float on said water;

said detachably connected wall members defining an occupancy space, said occupancy space configured to accommodate said one or more users, wherein said accommodated one or more users are protected by said buoyant enclosure formed by said inflation of said inner inflatable member of said each of said detachably connected wall members, from said impacts from said different directions on said land and said water; and an access region defined by opening one of said detachably connected wall members, said access region configured to provide access to said occupancy space.

2. The amphibious protection apparatus of claim 1, wherein said outer layer of said each of said wall members comprises a plurality of material segments of predefined shapes, wherein each of said material segments defines a segment periphery, wherein said segment periphery of said each of said material segments is fastened to said segment periphery of another of said material segments to form said outer enclosed space for said accommodation and said inflation of said inner inflatable member.

3. The amphibious protection apparatus of claim 1, wherein said inner inflatable member of said each of said wall members is airtight and configured to conform to a shape defined by said outer layer of said each of said wall members when inflated.

4. The amphibious protection apparatus of claim 1, wherein said inner inflatable member of said each of said wall members comprises a plurality of material segments of predefined shapes, wherein each of said material segments defines a segment periphery, wherein said segment periphery of said each of said material segments is fastened to said segment periphery of another of said material segments to form said inner enclosed space for receiving said fluid injected into said inner inflatable member.

5. The amphibious protection apparatus of claim 1, further comprising an access port positioned at a vertex where at least three of said wall members meet, wherein said access port is configured to perform one or more of: introducing a navigation member into said occupancy space for navigating said amphibious protection apparatus, allowing entry of air into said occupancy space, and disposing waste matter from said occupancy space.

6. The amphibious protection apparatus of claim 5, further comprising a double convex lens positioned at one end of said access port proximal to said occupancy space and a convexo concave lens positioned at a distal end of said access port exposed to an external environment, wherein arrangement of said double convex lens and said convexo concave lens in said access port is configured to magnify external objects present in said external environment.

7. The amphibious protection apparatus of claim 6, wherein said double convex lens and said convexo concave lens are made of plastic.

8. The amphibious protection apparatus of claim 6, wherein said double convex lens and said convexo concave lens are further configured to preclude entry of foreign objects into said occupancy space through said access port.

9. The amphibious protection apparatus of claim 1, further comprising a fastener connected at said wall periphery of said outer layer of said each of said wall members, wherein said fastener is configured to attach and detach said each of said wall members.

10. The amphibious protection apparatus of claim 9, wherein said fastener is one of a zipper and a hook and loop fastener.

11. The amphibious protection apparatus of claim 1, wherein said outer layer of said each of said wall members is made of a flexible and impact resistant material to absorb shock and cushion said accommodated one or more users from impact of external objects.

12. The amphibious protection apparatus of claim 1, wherein said predefined configuration of said buoyant enclosure formed by said inflation of said inner inflatable member of said each of said detachably connected wall members is one of a polyhedral configuration, a cubic configuration, a cuboidal configuration, and a spherical configuration.

13. The amphibious protection apparatus of claim 1, further comprising an inflation unit operably connected to said each of said wall members, wherein said inflation unit is configured to inject said fluid into said inner enclosed space of said inner inflatable member of said each of said wall members to instantly inflate said each of said wall members.

14. The amphibious protection apparatus of claim 1, further comprising a valve operably positioned on said each of said wall members, wherein said valve is configured to one of inject said fluid into and eject said fluid out of said inner enclosed space of said inner inflatable member of said each of said wall members for inflation and deflation of said each of said wall members.

15. A method for providing safety to one or more users from impacts from different directions on land and water, said method comprising:

providing an amphibious protection apparatus, comprising:

a set of wall members, each of said wall members being foldably and detachably connected to another of said wall members, said each of said wall members comprising an outer layer of a predetermined thickness and an inner inflatable member, said outer layer of said each of said wall members defining a wall periphery, said wall periphery of said outer layer of said each of said wall members connected to said wall periphery of said outer layer of another of said wall members, said outer layer of said each of said wall members defining an outer enclosed space, said outer enclosed space configured to accommodate said inner inflatable member comprising an inner enclosed space;

said detachably connected wall members defining an occupancy space; and an access region defined by opening one of said detachably connected wall members;

assembling and detachably connecting said each of said wall members of said amphibious protection apparatus to said another of said wall members;

providing access to said occupancy space through said access region of said amphibious protection apparatus;

accommodating said one or more users within said occupancy space defined by said detachably connected wall members; and injecting a fluid into said inner enclosed space of said inner inflatable member of each of said detachably connected wall members to inflate said inner inflatable member of said each of said detachably connected wall members to form a buoyant enclosure of a predefined configuration configured to bounce on said land and float on said water, wherein said buoyant enclosure encloses said accommodated one or more users within said occupancy space to protect said accommodated one or more users from said impacts from said different directions on said land and said water, thereby providing said safety to said accommodated one or more users on said land and said water.

16. The method of claim 15, wherein said outer layer of said each of said wall members comprises a plurality of material segments of predefined shapes, wherein each of said material segments defines a segment periphery.

17. The method of claim 16, further comprising fastening said segment periphery of said each of said material segments to said segment periphery of another of said material segments to form said outer enclosed space for said accommodation and said inflation of said inner inflatable member.

18. The method of claim 15, wherein said inner inflatable member of said each of said wall members is airtight and configured to conform to a shape defined by said outer layer of said each of said wall members when inflated.

19. The method of claim 15, wherein said inner inflatable member of said each of said wall members comprises a plurality of material segments of predefined shapes, wherein each of said material segments defines a segment periphery.

20. The method of claim 19, further comprising fastening said segment periphery of said each of said material segments to said segment periphery of another of said material segments to form said inner enclosed space for receiving said fluid injected into said inner inflatable member.

21. The method of claim 15, wherein said injection of said fluid into said inner enclosed space of said inner inflatable member of said each of said detachably connected wall members to inflate said inner inflatable member is performed by an inflation unit operably connected to said each of said wall members.

22. The method of claim 15, wherein said amphibious protection apparatus further comprises an access port positioned at a vertex where at least three of said wall members meet, wherein said access port is configured to perform one or more of: introducing a navigation member into said occupancy space for navigating said amphibious protection apparatus, allowing entry of air into said occupancy space, and disposing waste matter from said occupancy space.

23. The method of claim 22, further comprising magnifying external objects present in an external environment by an arrangement of a double convex lens and a convexo concave lens in said access port, wherein said double convex lens is positioned at one end of said access port proximal to said occupancy space and said convexo concave lens is positioned at a distal end of said access port exposed to said external environment.

24. The method of claim 15, wherein said amphibious protection apparatus further comprises a valve operably positioned on said each of said wall members, wherein said valve is configured to one of inject said fluid into and eject said fluid out of said inner enclosed space of said inner inflatable member of said each of said wall members for inflation and deflation of said each of said wall members.

* * * * *